US010821437B2

(12) United States Patent
Glazier et al.

(10) Patent No.: US 10,821,437 B2
(45) Date of Patent: Nov. 3, 2020

(54) COMPACT MICROFLUIDIC STRUCTURES FOR MANIPULATING FLUIDS

(71) Applicant: Indiana University Research and Technology Corporation, Indianapolis, IN (US)

(72) Inventors: James A. Glazier, Bloomington, IN (US); Stephen C. Jacobson, Bloomington, IN (US); Dragos Amarie, Bloomington, IN (US)

(73) Assignee: The Trustees of Indiana University, Bloomington, IN (US)

( * ) Notice: Subject to any disclaimer, the term of this patent is extended or adjusted under 35 U.S.C. 154(b) by 192 days.

(21) Appl. No.: 16/105,002

(22) Filed: Aug. 20, 2018

(65) Prior Publication Data

US 2019/0009273 A1 Jan. 10, 2019

Related U.S. Application Data

(60) Division of application No. 15/198,359, filed on Jun. 30, 2016, now Pat. No. 10,052,628, which is a (Continued)

(51) Int. Cl.
*B01L 3/00* (2006.01)
*B01F 5/06* (2006.01)
(Continued)

(52) U.S. Cl.
CPC ..... *B01L 3/502715* (2013.01); *B01F 3/0865* (2013.01); *B01F 5/06* (2013.01);
(Continued)

(58) Field of Classification Search
CPC ..... B01L 3/502715; B01F 2003/0896; B01F 5/06; B01F 5/0601; B01F 13/0059;
(Continued)

(56) References Cited

U.S. PATENT DOCUMENTS 5,858,187 A 1/1999 Ramsey et al.
6,333,019 B1 * 12/2001 Coppens ..... B01F 5/06 23/293 R (Continued)

FOREIGN PATENT DOCUMENTS

EP 1338894 8/2003
EP 1643231 4/2006

(Continued)

OTHER PUBLICATIONS

PCT International Search Report for PCT/US2008/076868 completed by the EP Searching Authority on Dec. 5, 2008.

(Continued)

*Primary Examiner* — Anshu Bhatia

(74) *Attorney, Agent, or Firm* — Barnes & Thornburg LLP

(57) ABSTRACT

Disclosed is a method and apparatus for manipulating fluids. The apparatus may include a microfluidic structure including inlet channels (1 and 2) and outlet channels (306, 307, 308, 309, 310, 311, 312, 313, and 314) oriented among bifurcated (5), trifurcated (6) and merging junctions (7 and 8). The apparatus splits and merges fluids flowing in the channels to produce successive dilutions of the fluids within the outlet channels. Multiple apparatus may be combined in serial, parallel, combined serial and parallel and/or stacked configurations. One or more apparatus may be used alone or to provide various devices or chambers with the diluted fluids.

8 Claims, 23 Drawing Sheets

Related U.S. Application Data continuation of application No. 12/678,237, filed as application No. PCT/US2008/076868 on Sep. 18, 2008, now Pat. No. 9,440,207.

(60) Provisional application No. 60/973,239, filed on Sep. 18, 2007.

(51) Int. Cl.
*B01F 15/04* (2006.01)
*B01F 13/00* (2006.01)
*B01F 3/08* (2006.01)

(52) U.S. Cl.
CPC ..... *B01F 5/0601* (2013.01); *B01F 13/0059* (2013.01); *B01F 13/0062* (2013.01); *B01F 15/0404* (2013.01); *B01F 2003/0896* (2013.01); *B01F 2215/0037* (2013.01); *B01L 3/502776* (2013.01); *B01L 2200/0694* (2013.01); *B01L 2200/12* (2013.01); *B01L 2300/0861* (2013.01); *B01L 2300/0864* (2013.01); *B01L 2300/0867* (2013.01); *B01L 2300/0896* (2013.01); *B01L 2400/0415* (2013.01)

(58) Field of Classification Search
CPC ..... B01F 13/0062; B01F 15/0404; B01F 2215/0037; B01F 15/0408; B01F 3/0865; B01F 3/088; B01F 5/0403; B01F 15/00149; B01F 15/0022; B01F 15/00227; B01F 15/00285; B01F 15/00344; B01F 15/00357; B01F 15/0238; B01F 15/0416; B01F 2005/0028; B01F 2215/004; B01F 2215/0096; B01F 2215/0431; C11D 7/04; G05D 11/131; H01L 21/02052
See application file for complete search history.

(56) References Cited

U.S. PATENT DOCUMENTS

| | | | |
|---|---|---|---|
| 6,645,432 | B1 | 11/2003 | Anderson et al. |
| 6,929,750 | B2 | 8/2005 | Laurell et al. |
| 2004/0129336 | A1 | 7/2004 | Jeon et al. |
| 2007/0007204 | A1 | 1/2007 | Schanz et al. |

FOREIGN PATENT DOCUMENTS

| | | | |
|---|---|---|---|
| WO | 03015890 | A | 3/2003 |
| WO | 03072255 | A | 9/2003 |
| WO | 2006030952 | A | 3/2006 |

OTHER PUBLICATIONS

Jacobson, S.C., et al., "Microfluidic Devices for Electrokinetically Driven Parallel and Serial Mixing", Analytical Chemistry, American Chemical Society., vol. 71 No. 20, Oct. 15, 1999, pp. 4455-4459.

* cited by examiner

COMPACT MICROFLUIDIC STRUCTURES FOR MANIPULATING FLUIDS

This application is a divisional of U.S. Ser. No. 15/198,359, filed Jun. 30, 2016, which is a continuation of U.S. Ser. No. 12/678,237 filed Jul. 1, 2010 (U.S. Pat. No. 9,440,207), which is a national stage entry of PCT/US2008/076868, which claims priority under 35 U.S.C. § 119(e) to U.S. Ser. No. 60/973,239, filed Sep. 18, 2007, the entire contents of which are incorporated herein by reference.

FIELD OF THE INVENTION

The invention relates to methods and apparatus for manipulating fluids. It is disclosed in the context of methods and apparatus for manipulating fluids using microfluidic structures.

BACKGROUND

Microfluidics is directed toward methods and apparatus for handling very small, for example, nanoliter to attoliter, volumes of fluids. Microfluidic devices typically contain chambers, channels and/or other components having sizes on the micrometer scale. Microfluidic systems have diverse and widespread potential applications. For example, technologies which include microfluidic components include inkjet printers, blood-cell-separation equipment, and equipment which performs biochemical detection, biochemical assays, biodefense assays, biohazard assays, chemotaxis assays, cell culture, chemical synthesis, combinatorial chemistry, crystallization, drug screening, electrochromatography, genetic analysis, laser ablation, mechanical micromilling, medical diagnostics, microdiagnostics, polymerase chain reaction (per), solvation assays and surface micromachining.

SUMMARY

Apparatus and methods according to the disclosure include a plurality of channels oriented among a plurality of junctions configured to include at least two inlet channels and a number of outlet channels, oriented to manipulate the fluids introduced into the inlets and methods for using this apparatus.

In illustrative embodiments, the channels and junctions are oriented into a fluid manipulation region which includes bifurcated, trifurcated, and merging junctions. In illustrative embodiments, the apparatus is adapted to manipulate a number of fluids using the junctions and channels to produce multiple controlled successive dilutions of the fluids among other fluids. In illustrative embodiments, the manipulating region splits and merges the fluids so that the output of the manipulation region is a series of fluids with compositions including the original fluids and mixtures thereof.

In illustrative embodiments, the channels and junctions are oriented into one or more mixing levels. In one embodiment, two fluids introduced into the apparatus yield nine outputs when the manipulation region contains three mixing levels. An apparatus constructed according to the disclosure may manipulate fluids to form as many as $2^N+1$ outputs, where N is the number of mixing levels.

Additional features of the disclosure will become apparent to those skilled in the art upon consideration of the following detailed descriptions of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
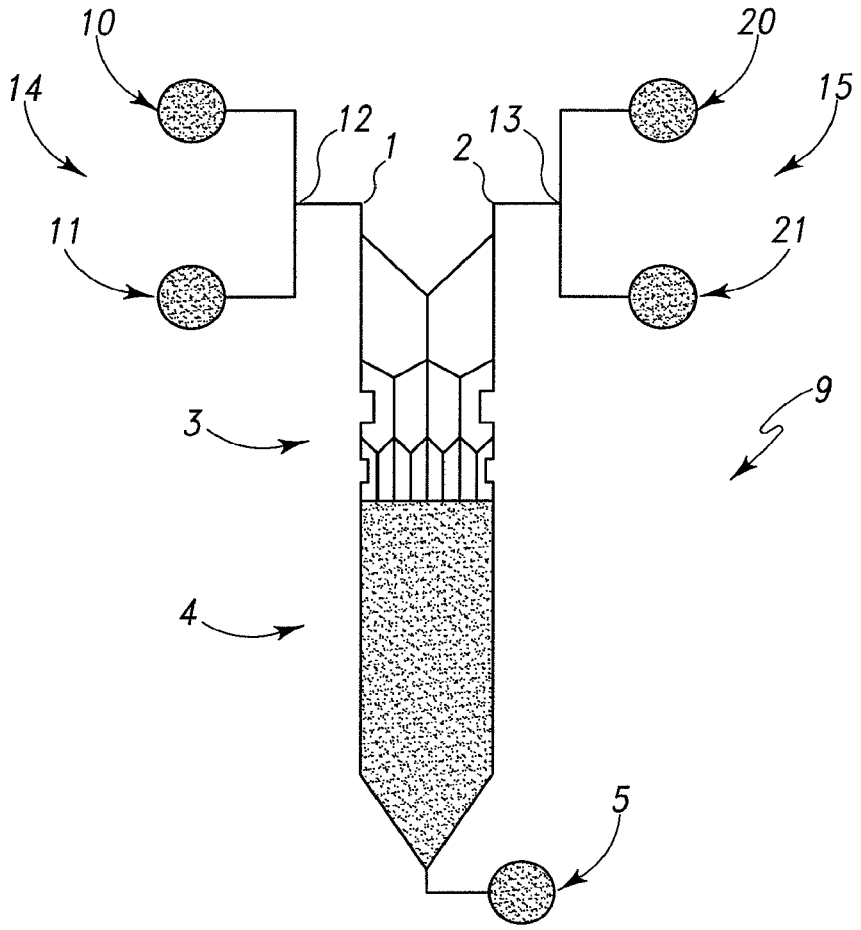
FIG. 1 illustrates a schematic of an apparatus according to the present disclosure.

The present disclosure relates to an apparatus for manipulating fluids, and particularly to an apparatus for manipulating fluids using a microfluidic structure. More particularly, the present disclosure relates to an apparatus having a microfluidic structure with a plurality of channels and junctions for manipulating fluids and a method of using the same.

Microfluidic devices have found increasing use in chemical and biochemical analysis applications, known as "lab-on-a-chip" technologies. The small channel and chamber length scales in microfluidic devices, typically on the order of 1-100 μm, permit manipulation of nanoliter to attoliter fluid volumes using any number of means for forcing the fluids to flow through the channels and/or chambers, including applied hydrostatic or hydrodynamic forces and/or voltages. Microfluidic devices permit temporally and spatially precise and reproducible fluid delivery.

A previously unmet need in the field of microfluidic devices is the need for apparatus and methods for making reproducible and precise successive fluid dilutions on the nanoliter to attoliter scale. Of particular need is an apparatus that can make these dilutions while still maintaining a very small size. The size of the apparatus is important because it needs to interface with a variety of applications which utilize micrometer- and nanometer-sized components, such as the aforementioned lab-on-a-chip technologies. Furthermore, many applications require multiple dilution apparatus in a single confined area, such as on a single chip; again, the size of the apparatus is important. In addition to the need for an apparatus capable of making precise and reproducible fluid mixtures, another previously unmet need in the field of microfluidics is apparatus and methods for quickly, accurately, and precisely changing the composition of a fluid within a channel or a chamber. In other words, there is a need for apparatus and methods capable of producing reproducible and accurate temporal and spatial fluid composition manipulations. For example, chemical concentrations varying in time and/or space are of particular interest for drug discovery, medical diagnostics and biomedical research applications.

The disclosed microfluidic devices have structures capable of making reproducible and precise successive dilutions on the nanoliter to attoliter volume scale. The disclosed microfluidic devices can be made on very small size scales which are compatible with advances in emerging microscale and nanoscale technologies such as lab-on-a-chip developments. The disclosed microfluidic devices have enabled a 10-fold diminution of apparatus size and corresponding reduction in volumes of fluids contained in such devices. The diminution of volume has also enabled the temporal response times of such devices to decrease.

The term dilution, as used herein, includes mixing two or more fluids together in a manner which results in a mixture of those fluids. The two or more fluids being mixed together may contain different concentrations of a particular molecule dissolved in the same solvent, or the fluids may be fluids with distinctly different compositions. For example, the fluids may be two aqueous solutions with different pH values or the fluids may be different organic solvents. Also within the meaning of the term dilution here, the fluids may be of entirely different phases (mixing a gas with a liquid or combining a liquid with solution containing solid components).

FIG. 1 illustrates a schematic of a three-level dilution-forming network. The structure includes a fluid manipulation region 3 (illustrated in greater detail in FIG. 4) which comprises channels and junctions (illustrated in FIGS. 2(*a*)-(*b*) and FIG. 3(*a*)) assembled in apparatus also including four inlet ports 10, 11, 20, and 21, an outlet port 5, and a diffusion chamber 4. As used herein, the term fluid manipulation meaning includes dilution forming region. The inlet ports are adapted to receive fluids, and respective channels connect the inlet ports to merging junctions 12 and 13. An inlet port is a location in which the microfluidic structure is connected to a fluid source. In one embodiment, an inlet port is a channel to which a tube or syringe can be connected. In other embodiments, inlet ports include microfluidic channels from a different microfluidic device or microfluidic channels incorporated into the same device. The fluid entering an inlet port is not limited to a constant composition, but rather, the fluid composition may depend upon operations which occur prior to entering the inlet port. In other words, fluid introduced into an inlet port may already have undergone some processes, including other microfluidic mixing or dilution-producing processes.

The merging junction 12 is coupled to inlet ports 10 and 11, the combination of which is sometimes referred to hereinafter as an inlet 14. The resulting merged channel is the inlet channel 1. Inlet ports 10 and 11 may be provided with fluids of different compositions and inlet 14 is adapted to deliver the fluids to the inlet channel 1 at any mixture of the fluids provided to inlet ports 10 and 11. For example, the composition delivered to inlet channel 1 may be 0% or 100% of the fluid provided to port 10, or 0% or 100% of the fluid provided to port 11. Furthermore, the composition delivered to inlet channel 1 may be any mixture of the fluids provided to ports 10 and 11 between 0% and 100%, depending upon the apparatus and methods that supply the fluids to ports 10 and/or 11. Similarly, inlet ports 20 and 21 may be provided with fluids of different compositions and the inlet 15 is adapted to deliver the fluids to the inlet channel 2 at any mixture of the fluids provided in inlet ports 20 and 21. For example, the composition delivered to inlet channel 2 may be 0% or 100% of the fluid provided to port 20 or 0% or 100% of the fluid provided to port 21. Furthermore, the composition delivered to inlet channel 2 may be any mixture of the fluids provided to ports 20 and 21 between 0% and 100%.

Figure 4:
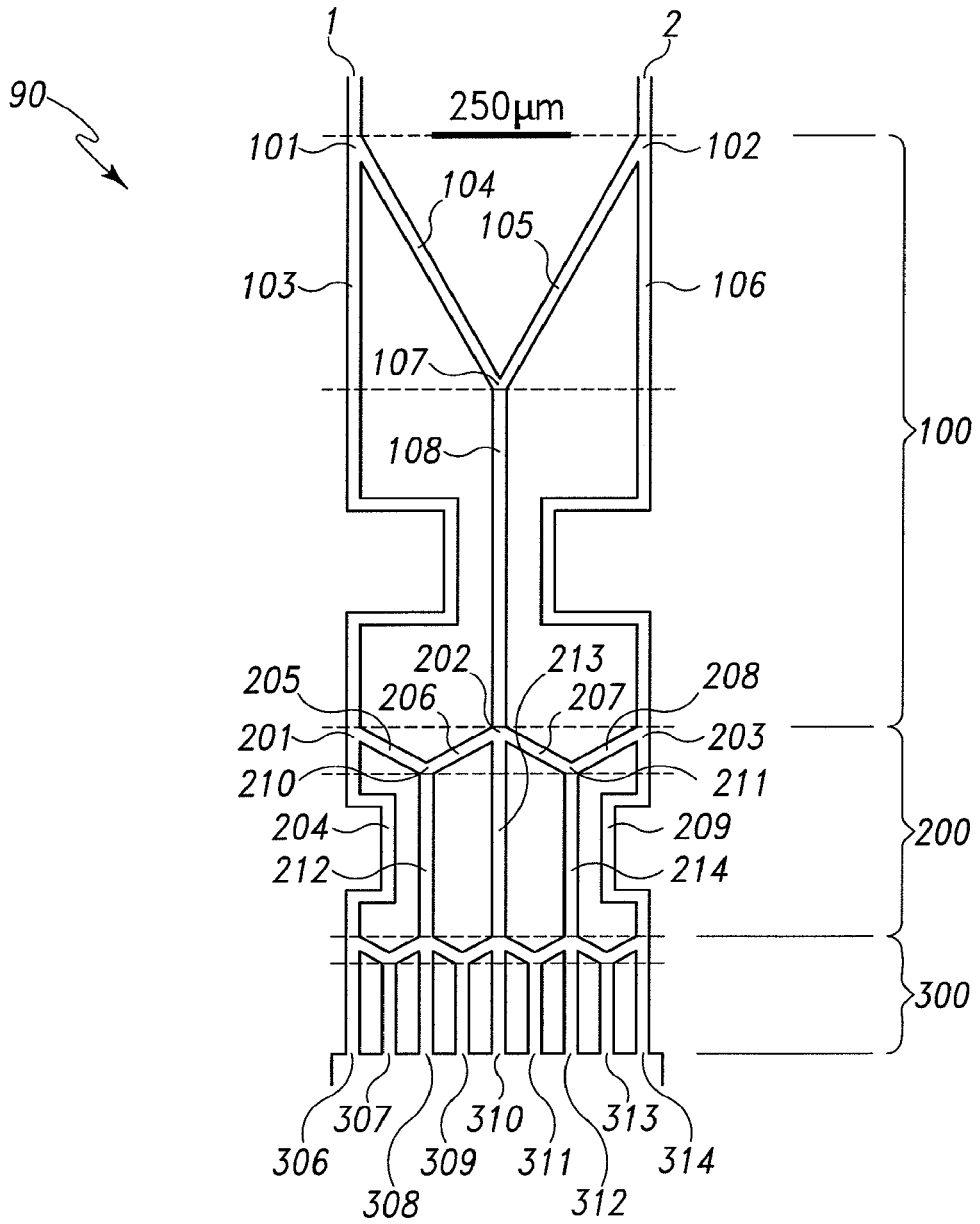
FIG. 4 illustrates enlarged details of the embodiment illustrated in FIG. 1.

Fluid manipulation region 3 is illustrated in greater detail in the schematic of FIG. 4. The basic principle is to mix the fluids delivered to inlet channels 1 and 2 both in parallel and in series by repetitively manipulating the fluid by splitting and merging the channels. In FIG. 4, the fluid composition introduced into the inlet channels 1 and 2 is maintained in the outside channels 306 and 314 (illustrated in greater detail in FIG. 5), respectively, of the fluid manipulation region. In addition, merging and splitting that occurs in the central portion of the fluid manipulation region results in the composition of the fluid in the outlet channels 307, 308, 309, 310, 311, 312, and 313 (see also FIG. 5) to be mixtures of the fluids introduced into inlet channels 1 and 2 in decreasing concentrations of the fluid introduced into inlet channel 1 and increasing concentrations of the fluid introduced into inlet channel 2 going from outlet channel 307 to outlet channel 313 (from left to right in FIGS. 4-5).

One aspect of the device illustrated in FIG. 4 is that the fluid manipulation region can be understood to have mixing levels, sometimes referred to hereinafter as levels. A first level or primary level 100 is defined as the portion of the fluid manipulation region where the inlet channels 1 and 2 connect with the bifurcating junctions 101 and 102 and extend with the transfer channels 103 and 106 toward another set of bifurcating junctions 201 and 203. Within the first level 100, however, the mixing channels 104 and 105 from bifurcating junctions 101 and 102, respectively, are merged at the merging junction 107 to form the merged channel 108. Similarly, the second level or secondary level 200 includes the bifurcating junctions 201 and 203 and the trifurcating junction 202 and extends to where the channels 204, 209, 212, 213, 214 encounter the bifurcating junctions 301 and 305 and the trifurcating junctions 302, 303 and 304.

Similarly, the third level or tertiary level 300 includes the portion of the fluid manipulation region between the bifurcating junctions 301 and 305 and the trifurcating channels 302, 303, and 304 and the level at which the channels 306, 307, 308, 309, 310, 311, 312, 313, and 314 encounter another feature of the apparatus. In the embodiment illustrated in FIGS. 1, 4 and 5, that other feature is the diffusion chamber 4.

One aspect of this configuration is that the number of possible outlet channels increases with the number of levels. Generally, for N levels, the number of possible outlet channels is equal to $2^N+1$. In embodiments such as that illustrated in FIGS. 1, 4 and 5, the composition of the fluid within each of the outlet channels 306, 307, 308, 309, 310, 311, 312, 313, 314 may be predicted based on the number of levels, N. For example, if the apparatus is designed to produce a linear series of solutions and the fluid introduced into the first inlet channel 1 has a concentration $C_1$ and the fluid introduced into the second inlet channel 2 has a concentration $C_2$, the concentration step $C_{step}$ between adjacent outlet channels 306, 307, 308, 309, 310, 311, 312, 313, 314 can be calculated by the equation:

$$C_{step} = \frac{|C_1 - C_2|}{2^N}.$$

For example, when N=1 $C_{step}$=50%, when N=2 $C_{step}$=25%, when N=3 $C_{step}$=12.5%, when N=4 $C_{step}$=6.25%, and so on.

One embodiment of the fluid manipulation region 3 was designed accordingly. The fluid manipulation region 3 was designed in stages, starting from the dilution outlet channels 306, 307, 308, 309, 310, 311, 312, 313, and 314 and working back to the inlet channels 1 and 2 to satisfy two criteria: (1) the flow velocity from each outlet channel should be the same and (2) the pressure or potential drop across any level should be constant. One approach to meeting these criteria is to design the channels so that within a level, the transfer channels (channels 103 and 106 in level 100 and channels 204 and 209 in level 200) are the same length, and the variable-length mixing or connector channels combine flows and adjust the flow resistance. Each transfer channel length was chosen to allow a sample entering a merging junction, sufficient time to mix by diffusion, according to the following equation:

$$\sigma = \sqrt{2Dt} = \sqrt{2D\frac{l}{u}},$$

where σ is the distance a soluble component diffuses in time t, D is the diffusion coefficient of the component, l is the channel length, and u is the velocity. In certain cases, complete mixing can be assumed when σ reaches half the channel width w.

The length of the mixing channels controls the hydrodynamic resistance; therefore, the lengths were adjusted to maintain a constant hydrostatic potential drop across a level for all flow paths. As an example, the primary level transfer channels 103 and 106 in FIGS. 1 and 4 are longer than the sum of the length of the primary level mixing channel 104 and the primary level merged channel 108, and longer than the sum of the length of the primary level mixing channel 105 and the primary level merged channel 108.

Figure 2A:
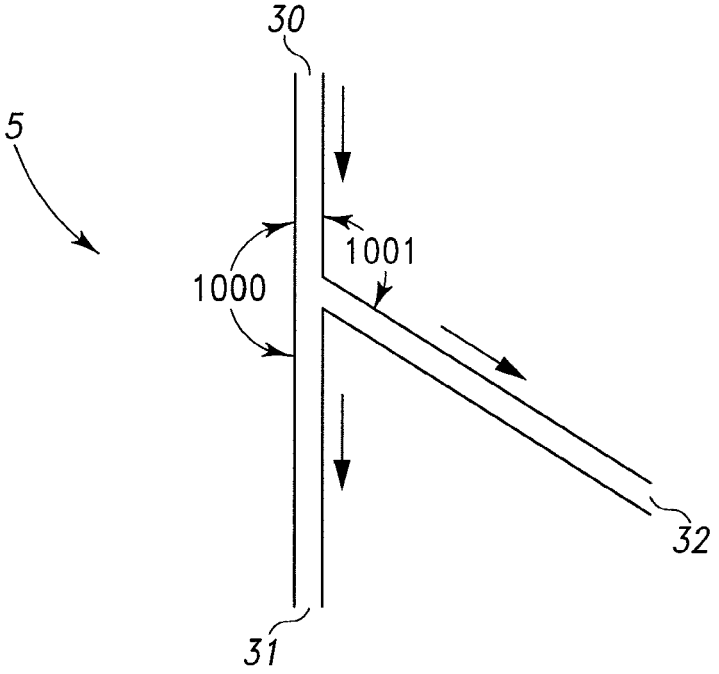
FIGS. 2(*a*)-(*b*) illustrate enlarged details of the embodiment illustrated in FIG. 1.
Figure 2B:
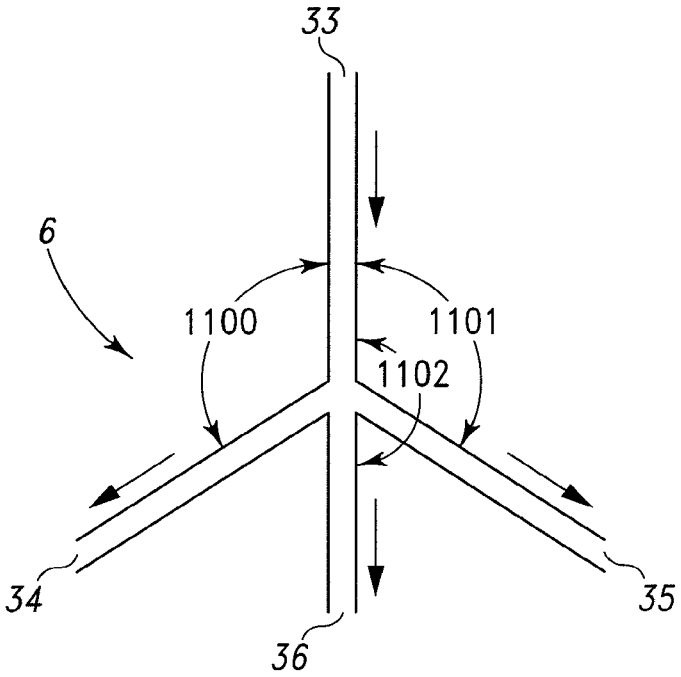
Figure 3A:
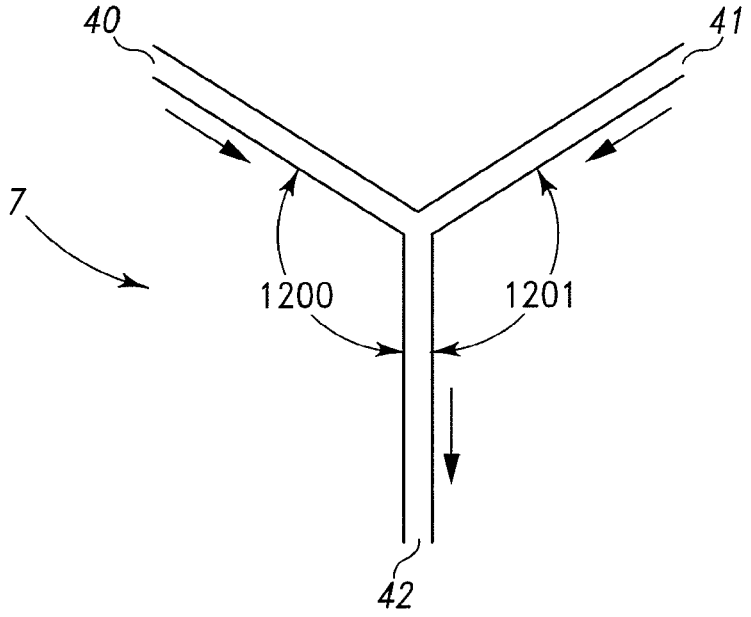
FIG. 3(*a*) illustrates an enlarged detail of the embodiment illustrated in FIG. 1 and FIG. 3(*b*) illustrates an enlarged alternative detail.
Figure 3B:
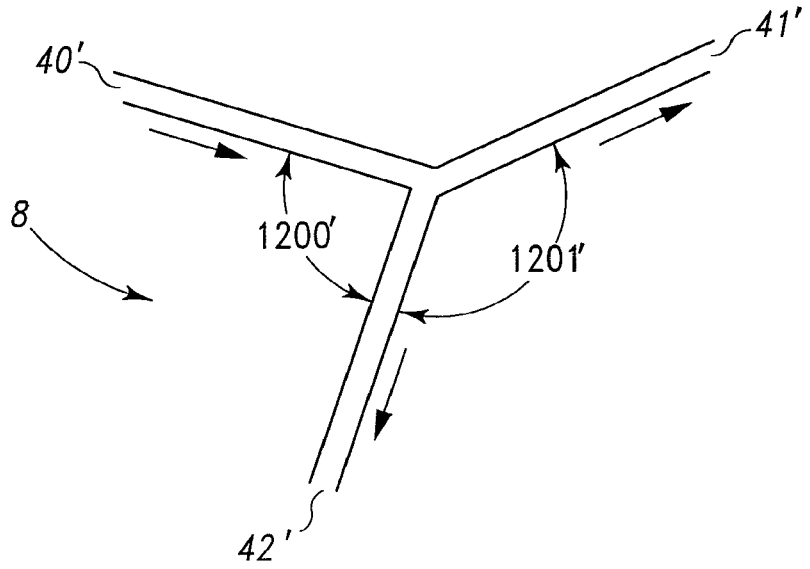

An apparatus constructed according to the present disclosure is constructed from types of junctions, for example, bifurcated junctions 5 (FIG. 2(*a*)), trifurcated junctions 6 (FIG. 2(*b*)), and merging junctions 7 (FIG. 3(*a*)) and 8 (FIG. 3(*b*)). A bifurcated junction 5 splits the flow of fluid from an inlet channel 30 into two outlet channels 31 and 32. In one aspect, bifurcated junctions have an angle 1000 between the inlet channel 30 and the outlet channel 31 and a second angle 1001 between the inlet channel 30 and the outlet channel 32. In illustrative embodiments, the angles 1000 and 1001 may be any angle between 0 and 180 degrees. A trifurcated channel 6 splits the flow of fluid from an inlet channel 33 into three outlet channels 34, 35, and 36. In one aspect, trifurcated junctions have an angle 1100 between the inlet channel 33 and the outlet channel 34, a second angle 1101 between the inlet channel 33 and the outlet channel 35 and a third angle 1102 between the inlet channel 33 and the outlet channel 36. In illustrative embodiments, the angles 1100, 1101 and 1102 may be any angles between 0 and 180 degrees.

In one aspect, a symmetrical merging junction 7 (FIG. 3(*a*)) merges two inlet channels 40 and 41 into a single merged channel 42. In one aspect, merging junctions have an angle 1200 between the first inlet channel 40 and the outlet channel 42 and a second angle 1201 between the second inlet channel 41 and the outlet channel 42. In illustrative embodiments, the angles 1200 and 1201 may be any angles between 0 and 180 degrees. In illustrative embodiments, the fluid manipulation region may include an asymmetrical merging junction 8. Similarly to the symmetrical merging junction 7, it merges two inlet channels 40 and 41 into a single merged channel 42. In one aspect, merging junctions have an angle 1200' between the first inlet channel 40' and the outlet channel 42' and a second angle 1201' between the second inlet channel 41' and the outlet channel 42'. In illustrative embodiments, the angles 1200' and 1201' may be any angles between 0 and 180 degrees. However, the distinguishing feature between an asymmetrical merging junction 8 and a symmetrical merging junction 7 is that the angles 1200 and 1201 are substantially equal in a symmetrical merging junction 7, while the angles 1200' and 1201' are not substantially equal in an asymmetrical merging junction 8.

The input and output flow velocities for any level depend on the total number (N) of levels of the design, the level index (L), and the flow velocity ($u_f$) in the final level's (f) outlet channels as they exit. The level index denotes the particular level to which a calculation refers. For the bifurcated junction 5 illustrated in FIG. 2(*a*), the inlet and outlet flow velocities can be calculated using the equation:

$$u_{in1}(N,L)=u_{out1}(N,L)=(2^{N-L-1}+½)u_f,$$

where $u_{in1}$ is the velocity of the fluid in the inlet channel 30 and $u_{out1}$ is the velocity of the fluid in the outlet channels 31 and 32.

For the trifurcated junction 6 illustrated in FIG. 2(*b*), the inlet and outlet flow velocity can be calculated by using the equation:

$$u_{in2}(N,L)=u_{out2}(N,L)=2^{N-L-1}u_f,$$

where $u_{in2}$ is the velocity of the fluid in the inlet channel 33 and $u_{out2}$ is the velocity of the fluid in the outlet channels 34, 35 and 36.

For the merging junction 7 illustrated in FIG. 3(*a*), the inlet and outlet flow velocity can be calculated by using the equation:

$$u_{in3}(N,L)=u_{out3}(N,L)=2^{N-L}u_f$$

where (L) is the level, $u_{in3}$ is the flow velocity in the inlet channel 40 and 41 and $u_{out3}$ is the flow velocity in the outlet channel 42.

In illustrative embodiments, the disclosure provides a microfluidic structure for manipulating fluids, the microfluidic structure comprising M inlet channels and a plurality of channels oriented among a plurality of bifurcated, trifurcated and merging junctions, wherein M≥2. In another embodiment, the microfluidic structure comprises N mixing levels, wherein N≥1.

In another embodiment, the microfluidic structure comprises P outlet channels, where $P \leq 2^N+1$. In another embodiment, the introduction of a series of fluids into the inlet channels results in a series of fluids including diluted fluids flowing from the outlet channels. In another embodiment, the series of fluids flowing from the outlet channels includes mixtures of the fluids introduced into the inlet channels. In one embodiment, M=3, N=1, and the plurality of bifurcated, trifurcated, and merging junctions comprises two bifurcated junctions, one trifurcated junction, and two merging junctions. In another embodiment, M=2, N=2, and the plurality of bifurcated, trifurcated, and merging junctions comprises four bifurcated junctions, one trifurcated junction, and three merging junctions. In yet another embodiment, M=2, N=3 and the plurality of bifurcated, trifurcated, and merging junctions comprises six bifurcated junctions, four trifurcated junctions, and seven merging junctions. In another embodiment, M=2, N=4 and the plurality of bifurcated, trifurcated, and merging junctions comprises eight bifurcated junctions, eleven trifurcated junctions, and fifteen merging junctions. In another embodiment, the microfluidic structure further comprises a gradient chamber connected to the outlet channels. In another embodiment, the microfluidic structure further comprises an array of channels adapted to receive fluids from the outlet channels.

In another embodiment, a first fluid is provided to the first inlet of the apparatus, a second fluid is provided to the second inlet of the apparatus and pressure is applied sufficient to cause the first and second fluids to flow through the apparatus and dilution of the first fluid by the second.

An illustrative embodiment provides a microfluidic structure for mixing a first fluid with a second fluid. The microfluidic structure comprises a first level comprising a set of three outlet channels. The first outlet channel contains the first fluid. The second outlet channel contains the second fluid. The third outlet channel contains a mixture of the first and second fluids. A second level comprises a set of five outlet channels. The first outlet channel contains the first fluid. The second outlet channel contains the second fluid. The third, fourth and fifth outlet channels contain mixtures of the first and second fluids.

In one embodiment, the microfluidic structure further comprises an $N^{th}$ level which can result in up to $2^N+1$ outlet ports. The first outlet port contains the first fluid. The second outlet port contains the second fluid. The remaining $2^N-1$ outlet ports contain mixtures of the first fluid and second fluids.

In illustrative embodiments, an apparatus comprises at least two inlet channels, up to $2^N+1$ outlet channels and at least one fluid manipulation region. The fluid manipulation region comprises a plurality of channels and a plurality of junctions including bifurcated junctions, trifurcated junctions and merging junctions. The plurality of channels and junctions are oriented into levels. The number of levels is N≥1. In an embodiment, the apparatus includes at least three outlet channels and a device or chamber connected to the at least three outlet channels. In one aspect, the device is used to perform performs biochemical detection, biochemical assays, biodefense assays, biohazard assays, chemotaxis assays, cell culture, chemical synthesis, combinatorial chemistry, crystallization, drug screening, electrochromatography, genetic analysis, laser ablation, mechanical micromilling, medical diagnostics, microdiagnostics, polymerase chain reaction (per), solvation assays and surface micromachining.

Figure 18:
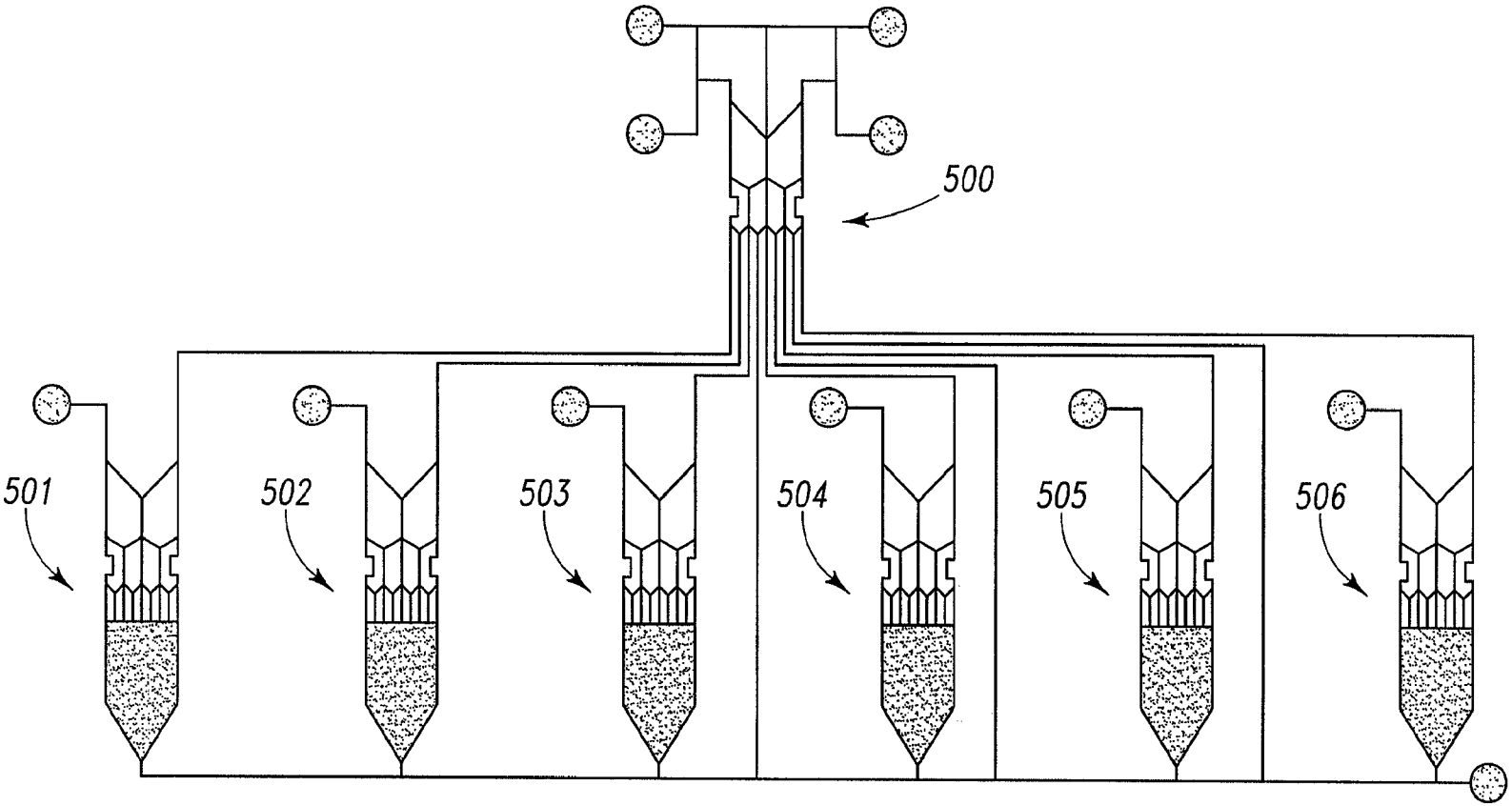
FIG. 18 illustrates a schematic of another embodiment constructed according to the disclosure.

In another aspect, apparatus of the present disclosure may be combined in series, combined in parallel, and combined in both series and parallel configurations. FIG. 18 illustrates one aspect of how multiple apparatus can be combined in serial and parallel configurations. The outlets from the first apparatus 500, are connected to the inlets of other apparatus 501, 502, 503, 504, 505, and 506. The first apparatus 500 combined with any of the other apparatus 501, 502, 503, 504, 505, and 506 is a series combination of apparatus. The utilization of the apparatus 501, 502, 503, 504, 505, and 506 with outputs of the first apparatus 500, is a parallel combination of apparatus. While the embodiment in FIG. 18 illustrates a gradient or diffusion chamber application, the serial and parallel combinations of the apparatus are general and not limited to this embodiment. Furthermore, in embodiments of which FIG. 18 is illustrative, it should be appreciated that more or fewer serial and/or parallel combinations are within the scope and spirit of the disclosure.

Figure 19A:
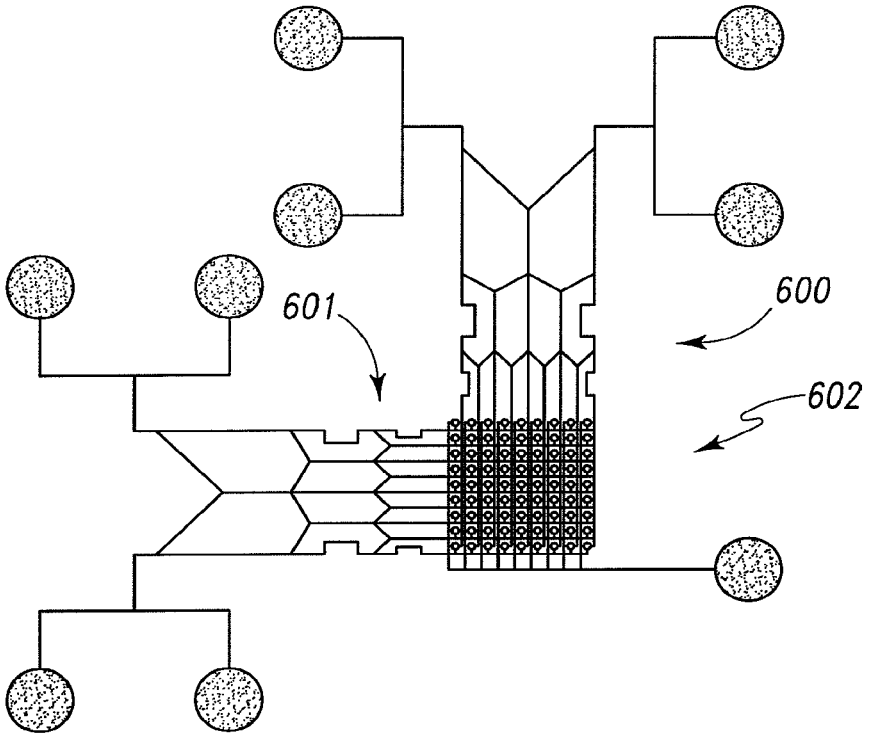
FIG. 19 (*a*)-(*b*) illustrates a schematic of another embodiment constructed according to the disclosure, and a cross-sectional view thereof; and, FIG. 20 (*a*)-(*b*) illustrates a schematic of another embodiment constructed according to the disclosure, and a cross-sectional view thereof.
Figure 19B:
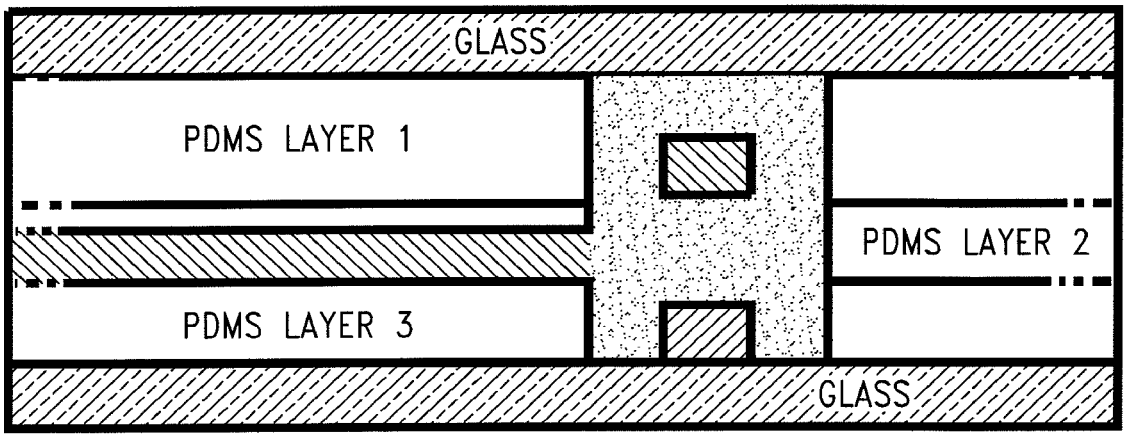
Figure 20A:
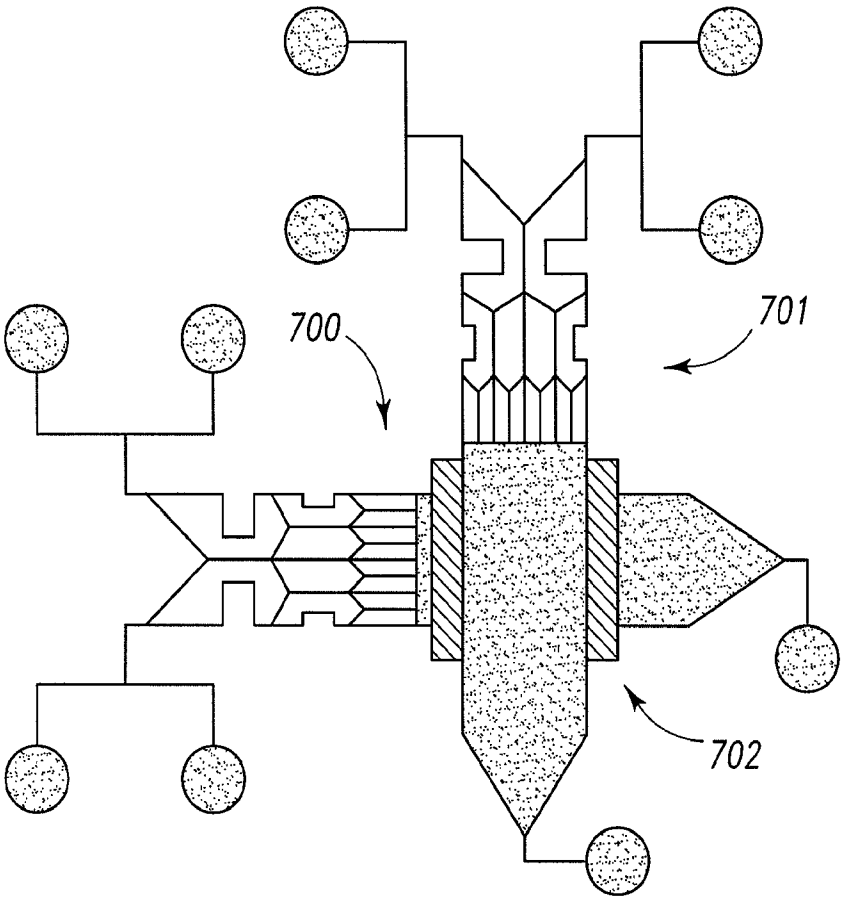
Figure 20B:
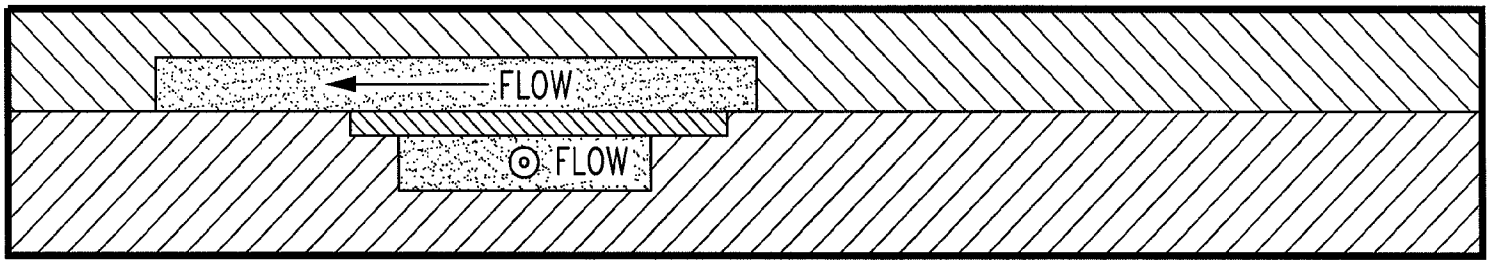

In another aspect, one or more outlet channels of two or more devices can directed into one or more chambers or channels so that the multiplicative nature of the apparatus can be utilized. For example, FIGS. 19 (*a*) and (*b*) illustrates a first apparatus 600 and a second apparatus 601 having outlets which are flowing into a region 602 in which the outlets are being combined. A cross-sectional view of the region 602 in which the outlets are being combined is illustrated in FIG. 19 (*b*). In this embodiment, the nine outlets of apparatus 600 and the nine outlets of apparatus 601 are being combined in the region 602 which contains eighty-one separate chambers. Each of the separate chambers of the region 602 will have different compositions according to the fluids introduced into apparatus 600 and 601. While the embodiment in FIG. 19 illustrates a combination of two apparatus, each with 3 levels and 9 outputs, the manner of combining apparatus in this way is general and not limited to this embodiment. For example, additional apparatus could be used and apparatus with more or fewer outlets could be similarly combined to produce more or fewer distinct mixtures. In yet another aspect, the combination of outputs from two or more apparatus may be combined in a continuous manner, as opposed to the discrete approach illustrated in FIG. 19. For example, FIGS. 20 (*a*) and (*b*) illustrates an embodiment in which a first apparatus 700 and a second apparatus 701 are connected to region 702 where gradient chambers for both apparatus have been operably connected. In one aspect, the two gradient chambers are separated by a membrane which permits diffusion between the gradient chambers. A cross-sectional view of the region 702 in which the gradient chambers are being combined is illustrated in FIG. 20 (*b*).

In another aspect, an apparatus according to the disclosure may be contained within a single plane. In this respect, multiple apparatus can be overlaid to form more complex configurations. In another aspect, a layer with a single or multiple combined apparatus can be combined with other layers containing a single or multiple combined apparatus so the layers are stacked. Stacked layers can be connected by channels or other means for operably connecting the layers or the layers can be stacked so that more apparatus can be combined in a smaller area.

In another aspect, the fluids can be caused to interact with a solid before entering an inlet or after exiting an outlet so that the fluid causes that solid to dissolve. In another aspect, the chamber is a diffusion chamber, reaction chamber, culture chamber or gradient chamber.

The term diffusion chamber, as used herein, describes a chamber in which multiple outlets are allowed to flow into a single defined area. Within the defined area, diffusion of the fluids from the different outlets will occur and composition gradients will form. In another aspect, the fluid manipulation region is adapted so that a fluid, flowing from each of the outlet channels into the gradient chamber will have a substantially equal velocity to the velocity of the fluid flowing from each of the other outlet channels. In yet another aspect, the channels have substantially equal cross-sectional areas. In another aspect, each level has an associated pressure drop and the pressure drop across each level is substantially equal. In another embodiment, the channels are so oriented that introducing a first fluid into a first inlet and a second fluid into a second inlet results in a concentration gradient between the first fluid and second fluids in a gradient chamber. In one aspect, the gradient has a shape which can be expressed as a non-linear function that can be normalized from one to zero in a finite space. In another aspect, the volume of the fluid within the fluid manipulation region may be less than about 15 nL. In yet another aspect, the volume of the fluid within the fluid manipulation region may be less than about 5 nL. In still another aspect, the volume of the fluid within the fluid manipulation region may be less than about 3.5 nL.

As illustrated in FIG. 1, an apparatus includes four inlet ports 10, 11, 20, and 21 which are connected to inlets 1 and 2 of the fluid manipulation region 3 through channels and two merging junctions 12 and 13. The fluid manipulation region 3 is connected to a diffusion region 4 and the diffusion region is connected to an outlet 5.

FIG. 4 illustrates a schematic of a fluid manipulation region 3. The illustrated fluid manipulation region comprises an inlet level 90 with a first inlet channel 1 and a second inlet channel 2. The fluid manipulation region 3 illustratively comprises a primary level 100 including a junction 101 in which the first inlet channel 1 is bifurcated into a first primary level transfer channel 103 and a first primary level mixing channel 104 and a second junction 102 in which the second inlet channel 2 is bifurcated into a second primary level transfer channel 106 and a second primary level mixing channel 105. The first primary level mixing channel 104 and the second primary level mixing channel 105 merge at a merging junction 107 to form a first primary level merged channel 108.

The fluid manipulation region 3 illustratively further comprises a secondary level 200 including a junction 201 in which the first primary level transfer channel 103 is bifurcated into a first secondary level transfer channel 204 and a first secondary level mixing channel 205. Additionally, the second primary level transfer channel 106 is bifurcated into a second secondary level transfer channel 209 and a second secondary level mixing channel 208. Additionally, the secondary level 200 comprises a trifurcated junction 202 in which the first primary level merged channel 108 is trifurcated into a third secondary level transfer channel 213, a third secondary level mixing channel 206, and a fourth secondary level mixing channel 207. Additionally, the secondary level 200 comprises a merging junction 210 merging the first secondary level mixing channel 205 and the third secondary level mixing channel 206 to form a first secondary level merged channel 212. Similarly, the second secondary level mixing channel 208 and the fourth secondary level mixing channel 207 merge at a merging junction 211 to form a second secondary level merged channel 214. In an illustrative embodiment, the fluid manipulation region 3 further comprises a tertiary level 300.

Figure 5:
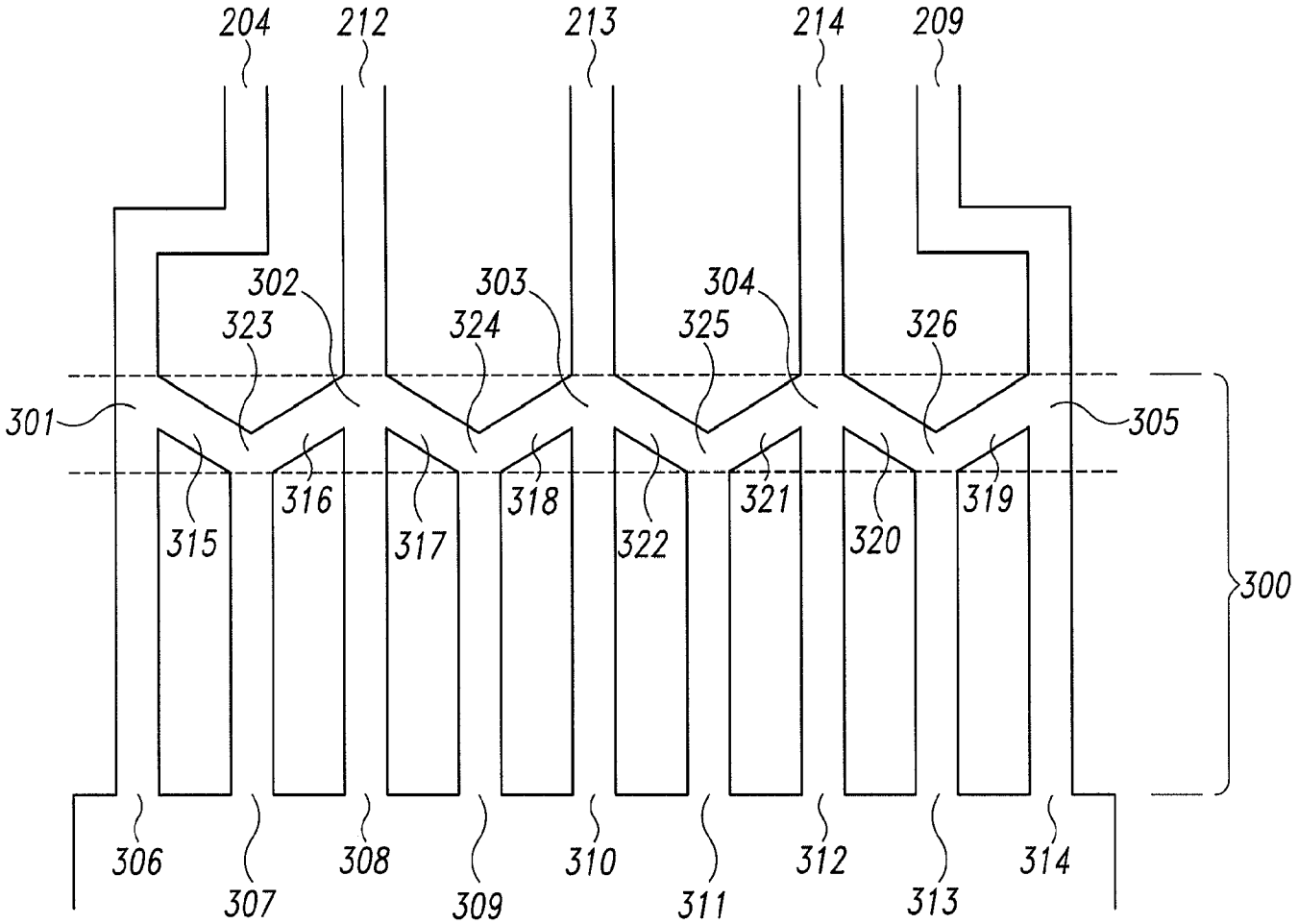
FIG. 5 illustrates enlarged details of the embodiment illustrated in FIG. 1.

The tertiary level 300 is illustrated in an enlarged view in FIG. 5. In an illustrative embodiment, the tertiary level 300 comprises a bifurcated junction 301 in which the first secondary level transfer channel 204 is bifurcated into a first tertiary level transfer channel 306 and a first tertiary level mixing channel 315. Similarly, the tertiary level 300 comprises a bifurcated junction 305 in which the second secondary level transfer channel 209 is bifurcated into a second tertiary level transfer channel 314 and a second tertiary level mixing channel 319. The tertiary level 300 includes three trifurcated junctions 302, 303, and 304. The first tertiary trifurcated junction 302 trifurcates the first secondary level merged channel 212 into a third tertiary level transfer channel 308, a third tertiary level mixing channel 316, and a fourth tertiary level mixing channel 317. The second tertiary trifurcated junction 303 trifurcates the second secondary level merged channel 213 into a fourth tertiary level transfer channel 310, a fifth tertiary level mixing channel 318, and a sixth tertiary level mixing channel 322. The third tertiary trifurcated junction 304 trifurcates the third secondary level transfer channel 214 into a fifth tertiary level transfer channel 312, a seventh tertiary level mixing channel 321, and an eighth tertiary level mixing channel 320. Additionally, the tertiary level 300 comprises a merging junction 323 in which the first tertiary level mixing channel 315 and the third tertiary level mixing channel 316 merge to form a first tertiary level merged channel 307. Similarly, the tertiary level comprises a merging junction 326 in which the second tertiary level mixing channel 319 and the sixth tertiary level mixing channel 320 merge to form a second tertiary level merged channel 313. Similarly, the tertiary level comprises a merging junction 324 which merges the fourth tertiary level mixing channel 317 and the seventh tertiary level mixing channel 318 to form a third tertiary level merged channel 309. Similarly, the tertiary level comprises a merging junction 325 which merges the eighth tertiary level mixing channel 322 and the fifth tertiary level mixing channel 321 to form a fourth tertiary level merged channel 311.

In one embodiment, the orientation of the channels causes a first fluid introduced into the first inlet channel 1 and a second fluid introduced into the second inlet channel 2 to form a series of successive dilutions in the first secondary level merged channel 212, the second secondary level merged channel 214, the first secondary level transfer channel 204, the second secondary level transfer channel 209, and the second secondary level transfer channel 213. In another embodiment, the orientation of the channels causes a first fluid introduced into the first inlet channel 1 and a second fluid introduced into the second inlet channel 2 to form a series of successive dilutions in the first tertiary level transfer channel 306, the second tertiary level transfer channel 314, the third tertiary level transfer channel 308, the fourth tertiary level transfer channel 312, the fifth tertiary level transfer channel 310, the first tertiary level merged channel 307, the second tertiary level merged channel 313, the third tertiary level merged channel 309, and the fourth tertiary level merged channel 311.

In one embodiment, the first and second inlet channels permit introduction of fluid fast enough to exchange the fluid in the channels in a time less than or about equal to 5 sec. In another embodiment, the first and second inlet channels permit introduction of fluid fast enough to exchange the fluid in the gradient chamber in a time less than or about equal to 2.6 sec. In another aspect, the apparatus further comprises a port level. At the port level, a first inlet port and a second inlet port are connected to a first inlet port channel and a second inlet port channel, respectively. The first inlet port channel and the second inlet port channel merge to form the first inlet channel. Also at the port level, a third inlet port and a fourth inlet port are connected to a third inlet port channel and a fourth inlet port channel, respectively. The third inlet port channel and the fourth inlet port channel merge to form the second inlet channel.

In illustrative embodiments, a method of mixing fluids comprises introducing a first fluid into a first inlet channel, introducing a second fluid into a second inlet channel, splitting the first fluid into two channels through a bifurcated junction, splitting the second fluid into two channels through a bifurcated junction, merging a first channel of the first fluid with a first channel of the second fluid, thereby forming a mixture of the first and second fluids, splitting the first fluid and the second fluid into a plurality of additional channels through a plurality of bifurcated and trifurcated junctions, and merging the first fluid, the second fluid and mixtures thereof into a plurality of additional channels through a plurality of mixing junctions. In one embodiment, the method further comprises causing the first fluid, the second fluid, and mixtures thereof to flow into a gradient chamber. In another embodiment, the method further comprises causing the first fluid, the second fluid, and mixtures thereof to flow into a gradient chamber in a spatial order of decreasing concentration of the first fluid and increasing concentration of the second fluid. In yet another embodiment the method further comprises causing the first fluid, the second fluid, and mixtures thereof to flow into a gradient chamber in a spatial order of substantially linearly decreasing concentration of the first fluid and increasing concentration of the second fluid.

Figure 10:
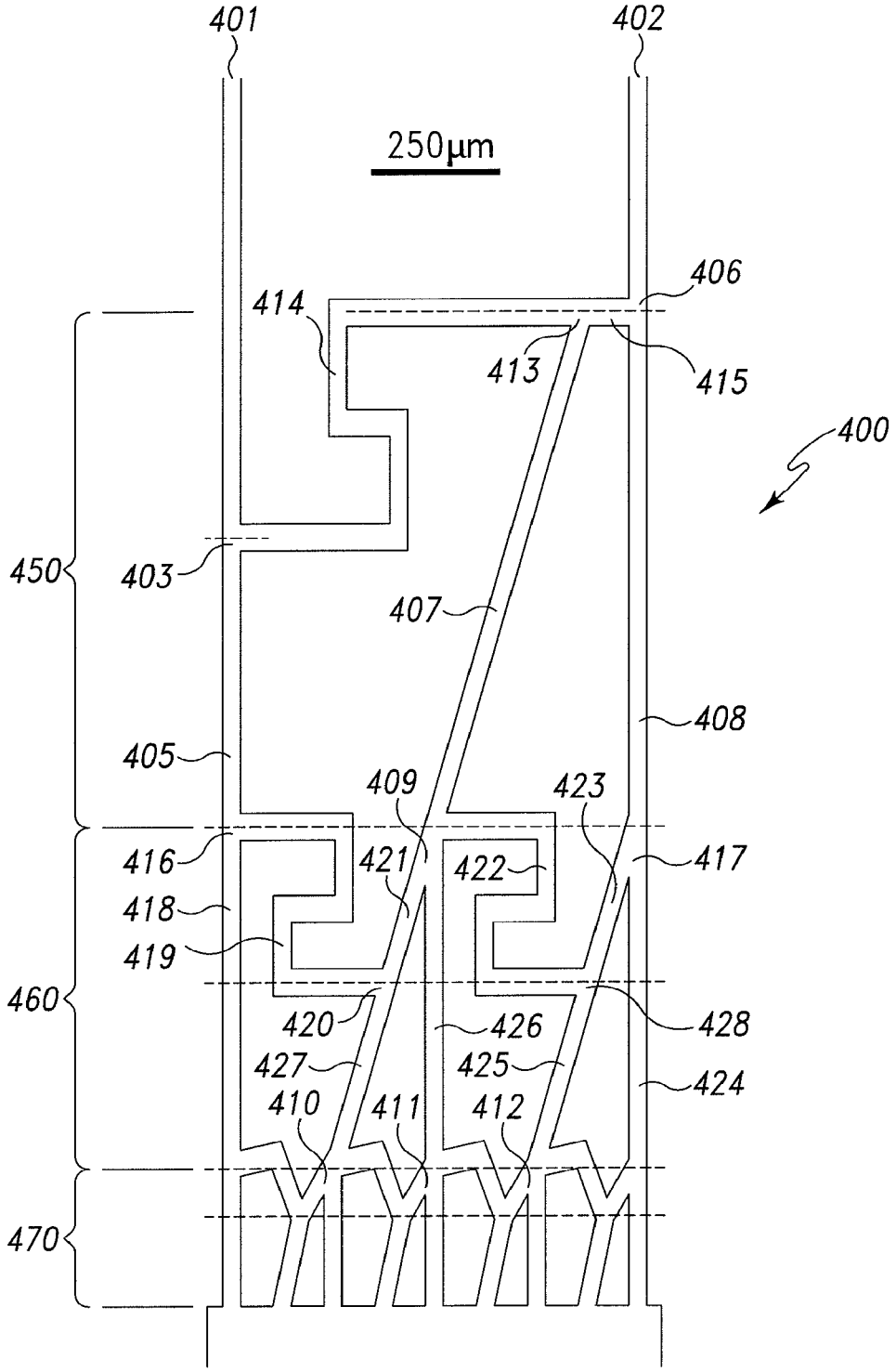
FIG. 10 illustrates enlarged details of the embodiment illustrated in FIG. 9.

FIG. 10 illustrates a schematic of another embodiment of a fluid manipulation region 400 for generating non-linear composition gradients across the series of outlets. The illustrated fluid manipulation region comprises a first inlet channel 401 and a second inlet channel 402. The fluid manipulation region 400 illustratively comprises a primary level 4500 including a junction 403 in which the first inlet channel 401 is bifurcated into a first primary level transfer channel 405 and a first primary level mixing channel 414 and a second junction 406 in which the second inlet channel 402 is bifurcated into a second primary level transfer channel 408 and a second primary level mixing channel 415. The first primary level mixing channel 414 and the second primary level mixing channel 415 merge at a merging junction 413 to form a first primary level merged channel 407.

The fluid manipulation region 400 illustratively further comprises a secondary level 460 including a junction 416 in which the first primary level transfer channel 405 is bifurcated into a first secondary level transfer channel 418 and a first secondary level mixing channel 419. Additionally, the second primary level transfer channel 408 is bifurcated into a second secondary level transfer channel 424 and a second secondary level mixing channel 423. Additionally, the secondary level 460 comprises a trifurcated junction 409 in which the first primary level merged channel 407 is trifurcated into a third secondary level transfer channel 426, a third secondary level mixing channel 421, and a fourth secondary level mixing channel 422. Additionally, the secondary level 460 comprises a merging junction 420 merging the first secondary level mixing channel 419 and the third secondary level mixing channel 421 to form a first secondary level merged channel 427. Similarly, the second secondary level mixing channel 423 and the fourth secondary level mixing channel 422 merge at a merging junction 428 to form a second secondary level merged channel 425. In an illustrative embodiment, the fluid manipulation region 400 further comprises a tertiary level 470. The tertiary level includes three trifurcated junctions 410, 411, and 412.

In yet another embodiment, the method comprises causing the first fluid, the second fluid, and mixtures thereof to flow into a gradient chamber in a spatial order such that the decreasing concentration of the first fluid and increasing concentration of the second fluid can be expressed as a non-linear function that can be normalized from one to zero in a finite space.

Figure 6:
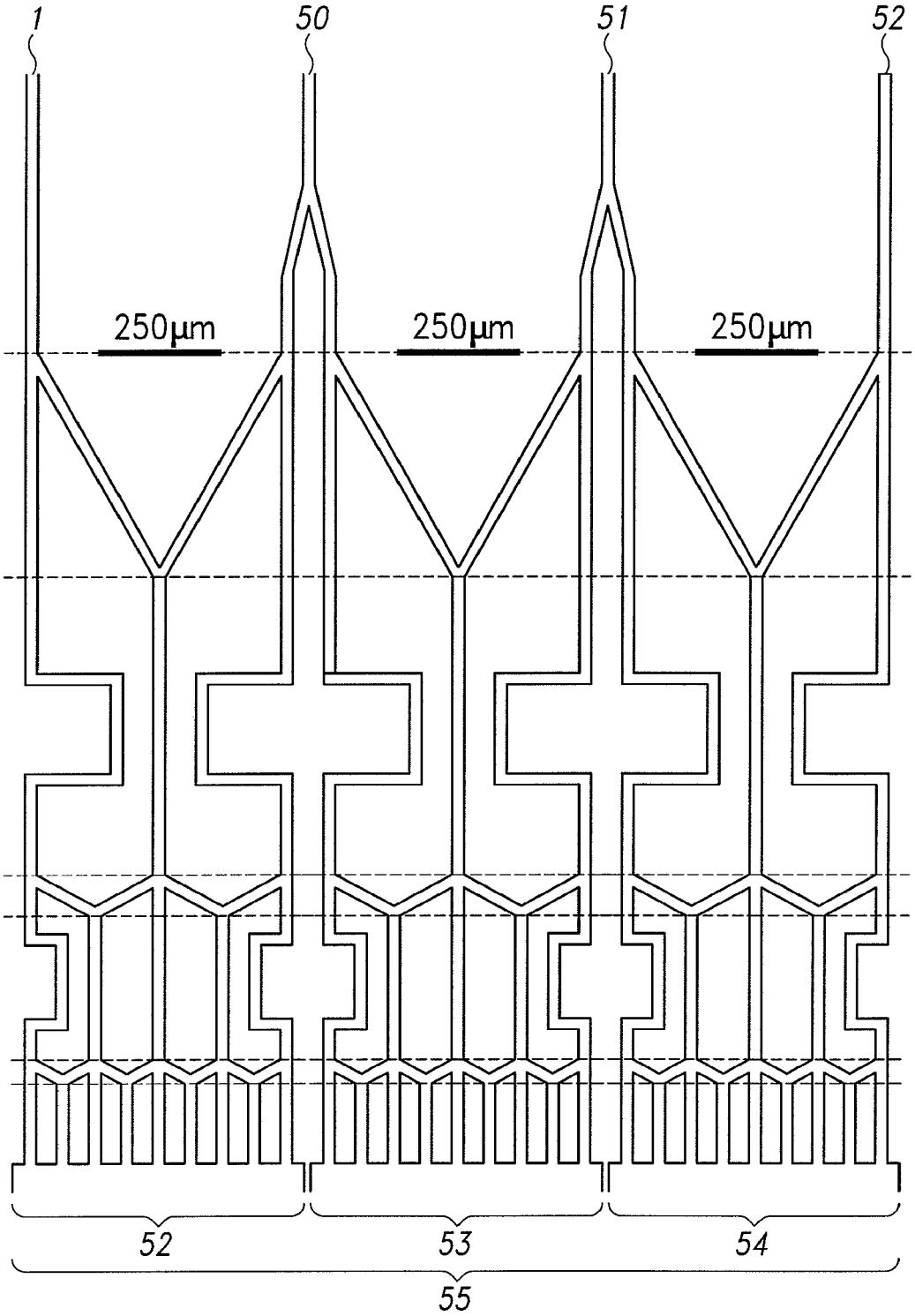
FIG. 6 illustrates an enlarged schematic of an embodiment including multiple coupled fluid manipulation regions.

In an embodiment illustrated in FIG. 6, fluid manipulation regions can be coupled at the inlet level. A first inlet channel 1, a second inlet channel 2, a third inlet channel 50, and a fourth inlet channel 51 are shown with three substantially identical fluid manipulation regions. The third inlet channel 50 is shown to be shared by two otherwise separate fluid manipulation regions. The fourth inlet channel 51 is shown to be shared by two otherwise separate fluid manipulation regions. The diffusion chambers 52, 53 and 54 can either be separated from each other or can be combined to form a single continuous gradient chamber 55.

As described above, FIG. 18 illustrates that apparatus of the present disclosure may be combined in series, combined in parallel, and combined in both series and parallel configurations. The outlets from the first apparatus 500, are connected to the inlets of other apparatus 501, 502, 503, 504, 505, and 506. The first apparatus 500 combined with any of the other apparatus 501, 502, 503, 504, 505, and 506 is a series combination of apparatus. The utilization of the apparatus 501, 502, 503, 504, 505, and 506 with outputs of the first apparatus 500, is a parallel combination of apparatus.

As described above, FIGS. 19 (*a*) and (*b*) illustrates a first apparatus 600 and a second apparatus 601 having outlets which are flowing into a region 602 in which the outlets are being combined. A cross-sectional view of the region 602 in which the outlets are being combined is illustrated in FIG. 19 (*b*). It will be appreciated that the manner in which the apparatus 600 and 601 are combined in region 602, as shown, the outlets of 600 and 601 are in different planes, therefore not connected at every intersection. In this embodiment, the nine outlets of apparatus 600 and the nine outlets of apparatus 601 are being combined in the region 602 which contains eighty-one separate chambers. Each of the separate chambers of the region 602 will have different compositions according to the fluids introduced into apparatus 600 and 601.

As described above, the combination of outputs from two or more apparatus may be combined in a continuous manner, as opposed to the discrete approach illustrated in FIG. 19. For example, FIGS. 20 (*a*) and (*b*) illustrates an embodiment in which a first apparatus 700 and a second apparatus 701 are connected to region 702 where gradient chambers for both apparatus have been operably connected. In one aspect, the two gradient chambers are separated by a membrane which permits diffusion between the gradient chambers. A cross-sectional view of the region 702 in which the gradient chambers are being combined is illustrated in FIG. 20 (*b*). Again, it will be appreciated that the gradient regions, as described in this embodiment, are in separate planes.

Benefits of these embodiments include forming gradients with very small sample volumes and displacement volumes. Reagent usage is reduced. Rapid temporal changes in the gradients can be achieved. Device size facilitates incorporation into lab-on-a-chip applications. Because of the small device size, multiple gradient chambers can be incorporated in a chip for high-throughput applications. Combinatorial experiments can be designed with more combinations, yet reduced reagent usage. Furthermore, and somewhat unexpectedly, the disclosed apparatus and methods form gradients with high temporal and spatial stability considering their size.

The following examples further illustrate the invention but, of course, should not be construed as in any way limiting its scope. These examples demonstrate that the disclosed apparatus and methods enable the precise and reproducible manipulation of fluids, thereby permitting successive dilutions. In the examples below, this demonstration was done in the preparation of a fluid gradient in a chamber. Further details can be found in D. Amarie, J. A. Glazier, and S. C. Jacobson *Anal. Chem.* 2007, 79, 9471-9477, the disclosure of which is hereby incorporated herein by reference.

Example 1

Fabrication of the Microfluidic Device

Master Fabrication.

Masters were formed on glass substrates (75×50×1 mm) cleaned in HCl:$HNO_3$ (3:1), rinsed with water (18 MΩ-cm, Super-Q Plus, Millipore Corp.), dried with nitrogen, sonicated in methanol and acetone (1:1), and dried with nitrogen. The master was created with two SU-8 2010 (MicroChem Corp.) photoresist layers, where the first layer (~20 μm thick) promoted adhesion of the channel structure to the substrate, and the second layer (~20 μm thick) created the channel structure. Both layers were identically processed, except that the first layer was exposed without a photomask. The photoresist was spin-coated (PWM32-PS-R790, Headway Research, Inc.) on the substrate by ramping at 40 rpm/s to 1000 rpm and holding at 1000 rpm for 30 sec. Prior to exposure, the photoresist was baked on a digital hot-plate (732P, PMC Industries) at 65° C. for 1 min, ramped to 95° C. at 100° C./hr, and held at 95° C. for 3 min.

The photomask design was created using AutoCAD LT 2004 (AutoDesk, Inc.) and the design was printed on a transparency using a high-resolution laser photoplotter at 40,640 dpi (Photoplot Store). The design was contact-printed on the photoresist using a UV exposure system (2055, Optical Associates, Inc.) equipped with a high-pressure Hg arc lamp and an additional 360 nm band filter (fwhm 45 nm, Edmund Optics, Inc.), with a total exposure of 300 mJ/$cm^2$. The exposed photoresist was post-baked on the hot-plate maintained at 65° C. for 1 min, ramped to 95° C. at 300° C./hr, and held at 95° C. for 1 min. The master was developed for 10 min, rinsed with 2-propanol, and dried with nitrogen. In one specific embodiment, the channel height of the SU-8 master with a stylus profiler (Dektak 6M, Veeco Instruments, Inc.) averaged 19.2±0.1 μm over 10 measurements across the master.

Channel Fabrication.

Micro-channels were cast in poly(dimethylsiloxane) (PDMS) substrates, using the SU-8 masters according to known techniques. The silicone elastomer kit (Sylgard 184, Dow Corning Corp.) contains a polymer base and curing agent that were mixed in a 10:1 ratio for 2-3 min. A tape barrier was placed around the mold to hold the elastomer mixture and the elastomer was poured onto the master. The PDMS was placed on the mold under low vacuum (~1 Torr) for 1 hr to enhance channel replication, then cured at 100° C. for 30 min. The hot PDMS substrate was the immediately separated from the master, avoiding the need for silanization of the mold. Holes were provided for fluidic connections to the channels through the elastomer with a 16 G needle for devices using pressure-driven flow and with a 3-mm diameter cork-borer for devices using electrokinetic transport. In one specific embodiment, the resulting device appeared as illustrated in FIG. 1.

Chip Assembly.

Prior to bonding, the PDMS substrates were rinsed with methanol, rinsed with toluene for less than 1 min, and sonicated in methanol for 3 min to remove residual toluene and any surface debris. Glass cover plates that had been cleaned in $NH_4OH$:$H_2O_2$:$H_2O$ (2:1:1) for an hour at 75° C., rinsed with water, and dried with nitrogen, were exposed with the PDMS substrate to an air plasma (PDC-32G, Harrick Plasma) for 40 sec. and then joined permanently. The microfluidic channels were primed with buffer (10 mM sodium tetraborate) through the waste reservoir to minimize bubble formation and uniformly wet the channels.

Optical Imaging

Figure 7A:
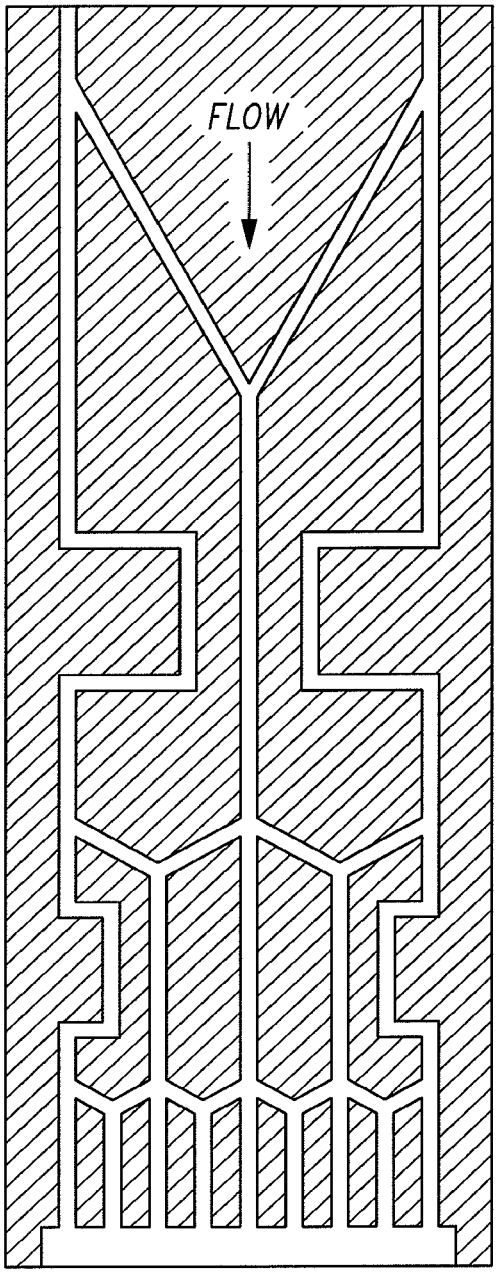
FIGS. 7(*a*)-(*c*) illustrate a fluid manipulation region, FIG. 7(*a*) is taken in transmitted light, and FIGS. 7(*b*) and (*c*) are fluorescence images illustrating characteristics of a mixing process.
Figure 7B:
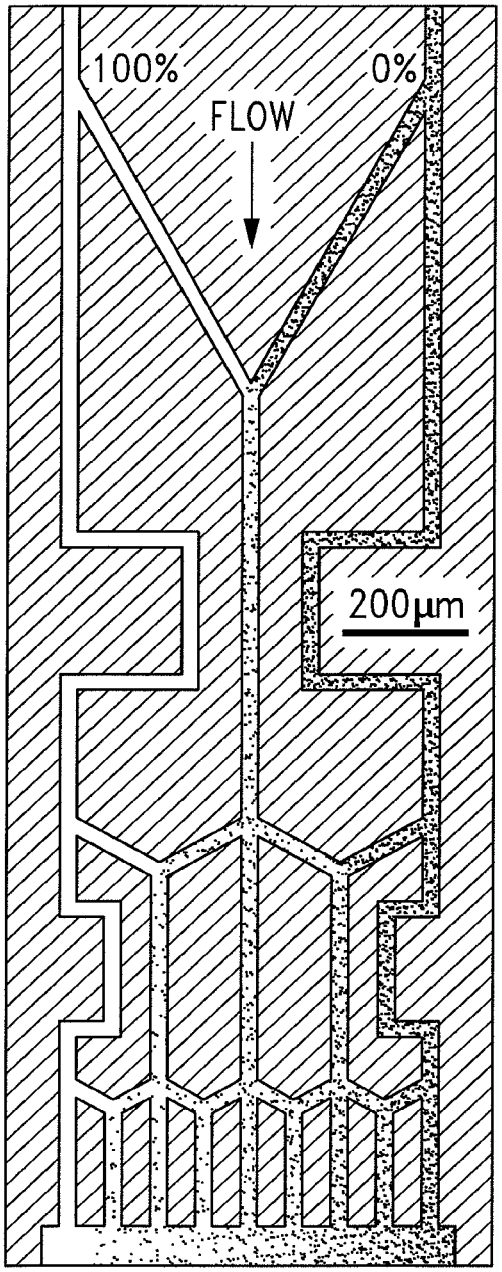
Figure 7C:
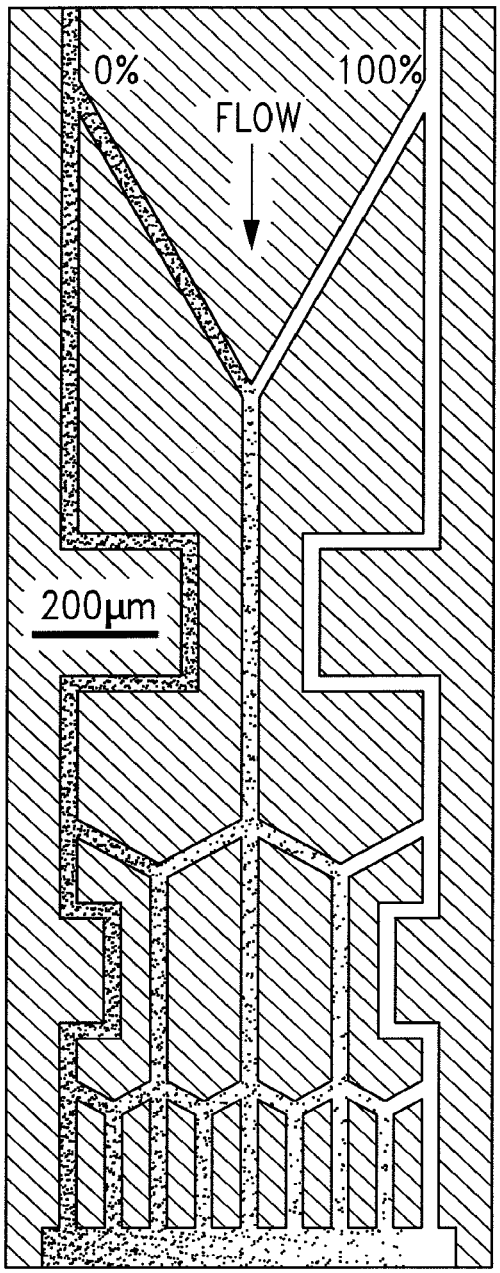

Fluid gradients through the microfluidics device were imaged using an inverted optical microscope (TE2000-U, Nikon, Inc.) equipped with a high-pressure Hg arc lamp and a CCD camera (CoolSnap HQ or Cascade 51213, Photometrics) controlled using MetaMorph imaging software (Molecular Devices Corp.). A 100 μM solution of disodium fluorescein in 10 mM sodium tetraborate buffer was placed in inlets 10 and 11 of the device 9 illustrated in FIG. 1, and a fluorescent probe and borate buffer without fluorescein was placed in inlets 20 and 21, allowing relative fluorescein concentrations from 0% to 100% at the tees 12 and 13. To process line profiles from the images, a background line profile was subtracted and normalized to a line profile of the gradient chamber filled entirely with the fluorescein solution. FIG. 7(*a*) illustrates a transmitted-light image of the fluid manipulation region for a device with 3 levels, 20 micrometer channel widths and 60 micrometer center-to-center spacing, usually designated herein as 3-20-60. FIG. 7 shows fluorescence images of the gradient for pressure-driven flow with FIG. 7(*b*) 100% sample at inlet channel 1 and 0% sample at inlet channel 2 and FIG. 7(*c*) 0% sample at inlet 1 and 100% sample at inlet 2. The output channels have concentration steps of substantially 12.5% from 100% to 0% in FIG. 7(*b*) and 0% to 100% in FIG. 7(*c*). The scale is the same in all images.

Flow Control

Pressure-driven and electrokinetic flow through the microfluidics device were both used to make dilutions for forming gradients. For pressure-driven flow, the ends of each channel were connected on the microchip to separate 10-mL graduated cylinders (mounted on vertical positioning stages) using 1.6 mm o.d. polypropylene tubing. Fluorescent polystyrene beads (770 nm diameter, PolySciences, Inc.) were added to the buffer in the inlet reservoirs ($10^4$ beads/μL) as velocity tracers to facilitate measurement of flow rates within the channels. A reference cylinder level was defined when the fluid heights in the inputs and waste cylinders were level and no fluid flow was detected in the channels. The hydrostatic pressure was controlled by adjusting the relative heights (ΔH) of the graduated cylinders with respect to the reference level. A 100 μm/s flow rate was achieved in the gradient chamber by lowering the waste reservoir to $\Delta H_{waste}$=−8.5 mm. Under this condition the fluorescein concentration within the gradient chamber was uniform (no gradient), i.e., 50% from inlet 14 and 50% from inlet 15. The relative fluorescein concentrations at mixing tees 12 and 13 (0-100%) were controlled hydrostatically by adjusting the cylinder heights for inlet 10 relative to inlet 11 for mixing tee 12 and for inlet 20 relative to inlet 21 for mixing tee 13. Adjustment of the cylinder heights was simultaneous, in opposite directions, and of the same displacement with respect to the reference level. For example, to obtain 75% fluorescein at mixing tee 12, cylinders connected to inlets 10 and 11 were set to $\Delta H_{10}$=2.2 mm and $\Delta H_{11}$=−2.2 mm.

For electrokinetic transport, electrical potentials were applied to the inlet reservoirs using custom-built high-voltage power supplies, controlled using LabView (National Instruments Corp.). Syringe filters (0.22 μm pore size) were placed into the channel access holes in the PDMS layer and then filled with buffer to act as reservoirs. Platinum electrodes inserted in the syringe filters provided electrical contact to the buffer. A reference voltage ($V_{ref}$=200 V) were defined at the point at which the fluorescein velocity in the gradient chamber was 100 μm/s, and the flow from inlets 14 and 15 is balanced (no gradient), i.e., 50% from inlet 14 and 50% from inlet 15. The relative fluorescein concentrations at tees, 12 and 13 (0-100%) were controlled electrically, by adjusting the potentials applied to inlet 10 relative to inlet 11 for tee 12 and to inlet 20 relative to inlet 21 for tee 13 ($\Delta V_{inlet}$=0-90 V). Changes to the applied potentials were simultaneous, of opposite sign, and of the same magnitude with respect to the reference voltage. For example, to obtain 75% fluorescein at tee 12, we set the potentials at inlets 10 and 11 to $\Delta V_{10}$=60 V and $\Delta V_{11}$=−60 V with respect to the reference voltage.

Gradient Formation

The results from testing three different apparatus with different numbers of dilution forming levels (three or four), channel widths (20 or 40 μm), and center-to-center output channel spacings (60 or 120 μm) will be included herein. The names of the devices 3-20-60, 3-40-120, and 4-20-60 correspond to their number of levels, channel widths and channel spacings, respectively. Table 1 summarizes their dimensions.

TABLE 1

Microfluidic Dilution Apparatus Specifications

| device | no. of levels (N) | channel width (μm) | channel spacing[a] (μm) | no. of output channels | chamber width (μm) |
|---|---|---|---|---|---|
| 3-20-60 | 3 | 20 | 60 | 9 | 540 |
| 3-40-120 | 3 | 40 | 120 | 9 | 1080 |
| 4-20-60 | 4 | 20 | 60 | 17 | 1020 |

[a]Center-to-center.

The gradient chamber width is the number of output channels times their center-to-center spacing. The gradient chamber ends in a tapered region connecting to a channel that flows into a waste reservoir. Our design assumes a liquid flow velocity of 100 μm/s in the gradient chamber, which is typical in microfluidic chemotaxis assays. For each chip, we measured the gradient profile at a longitudinal position l corresponding to a=0.745. This value corresponds to l=100 μm for devices 3-20-60 and 4-20-60 and l=400 μm for device 3-40-120. At these positions, using D=5×10$^{-6}$ cm$^2$/s for fluorescein, a maximum deviation of 0.02% is predicted from an ideal linear gradient. In our experiments, the gradients deviated less than 1% from the expected linear shape. The average flow velocity for 50 beads (770 nm diameter) was 99.8+/−7.4 μm/s for pressure-driven flow and 96.8 μm/s for electrokinetic flow, estimated by timing the displacement of the fluorescein front along the flow direction. These velocities were stable for up to 20 h.

Figure 11A:
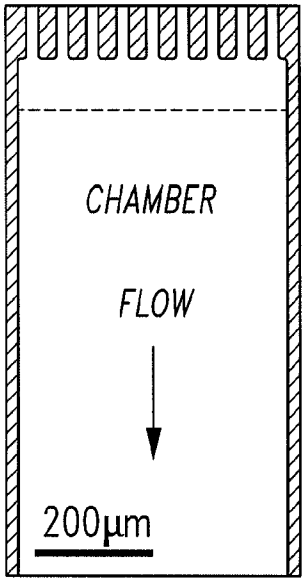
FIGS. 11(*a*)-(*c*) illustrate a fluid manipulation region, FIG. 11 (*a*) is taken in transmitted light, and FIGS. 11 (*b*) and (*c*) are fluorescence images illustrating characteristics of a mixing process.
Figure 11B:
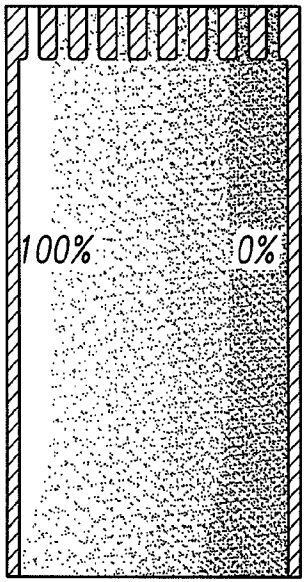
Figure 11C:
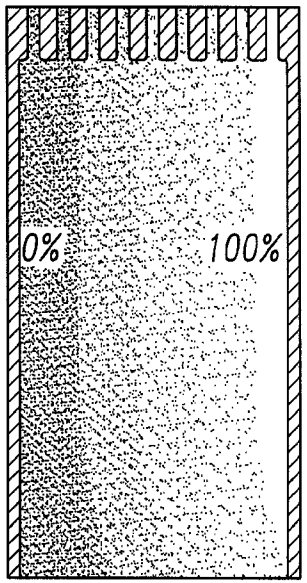
Figure 12A:
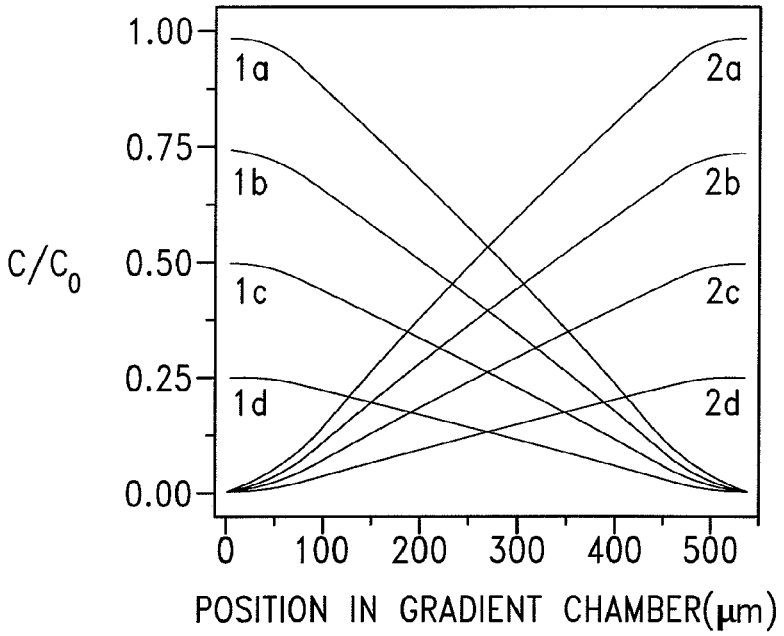
FIGS. 12(*a*)-(*b*) illustrate graphs of gradient profiles ($C/C_0$) with varying slopes, FIG. 12(*a*), and offsets, FIG. 12(*b*), for a device constructed according to the disclosure.
Figure 12B:
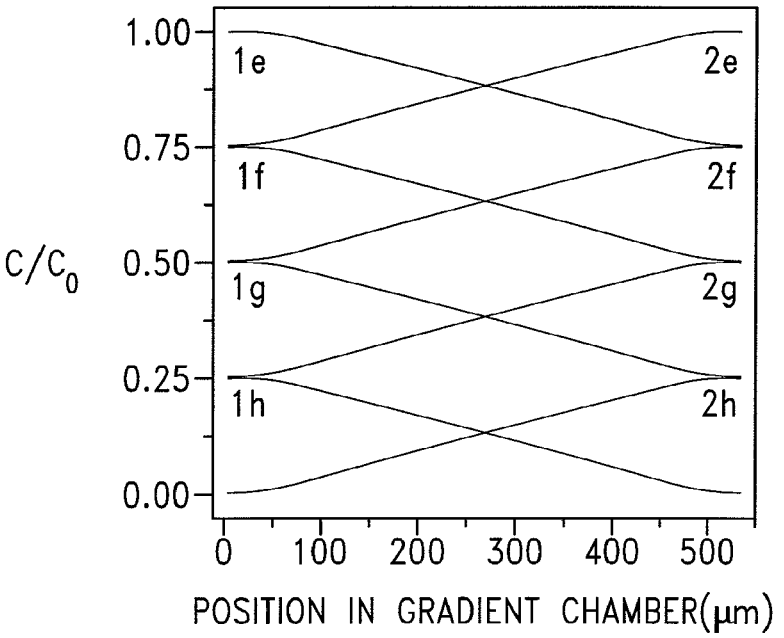

The fluorescence images in FIGS. 7(*b*)-(*c*) and 11(*b*)-(*c*) depict the gradient formed using device 3-20-60 in the gradient-forming region and gradient chamber, respectively. FIG. 7(*b*) shows 100% concentration of fluid 1 from mixing tee 1 mixing with 0% concentration of fluid 2 from mixing tee 2, and FIG. 7(*c*) shows 100% concentration of fluid 2 from mixing tee 2 mixing with 0% concentration of fluid 1 from mixing tee 1. The images in FIGS. 7(*b*)-(*c*) illustrate that the sample and buffer mixed completely in the transfer channels in each layer before reaching the next layer in the gradient forming region. FIGS. 11(*b*)-(*c*) illustrate how these gradients extended down the gradient chamber. FIG. 12(*a*) illustrates gradients with varying slopes for concentration 2 at merging junction 13 set to 0% and varying concentration 1 at merging junction 12 from 100% to 25% in 25% steps (FIG. 12(*a*) profiles 1*a*-1*d*, respectively), and for concentration 1 set to 0% and varying concentration 2 from 100% to 25% in 25% steps (FIG. 12(*a*) profiles 2*a*-2*d*, respectively). We also produced gradients with variable offsets and constant slope. FIG. 12(*b*) illustrates a series of gradient profiles with ΔC=25% across the gradient chamber and offsets in 25% increments. In FIG. 12(*b*), profiles 1*e*-1*h* illustrate concentration 1 stepped from 100% to 25% in 25% increments with concentration 2 simultaneously stepped from 75% to 0% also in 25% increments. In FIG. 12(*b*), profiles 2*e*-2*h* illustrate concentration 2 stepped from 100% to 25% in 25% increments with concentration 1 simultaneously stepped from 75% to 0% also in 25% increments. When changing the gradient composition, we typically adjusted the cylinder heights, waited for 10 s, and imaged the new composition. The time to achieve a new stable gradient was 2.6 s for device 3-20-60, which corresponded to displacing 5.27 nL in the fluid manipulation region between merging junctions 12 and 13 and the gradient chamber.

Figure 8A:
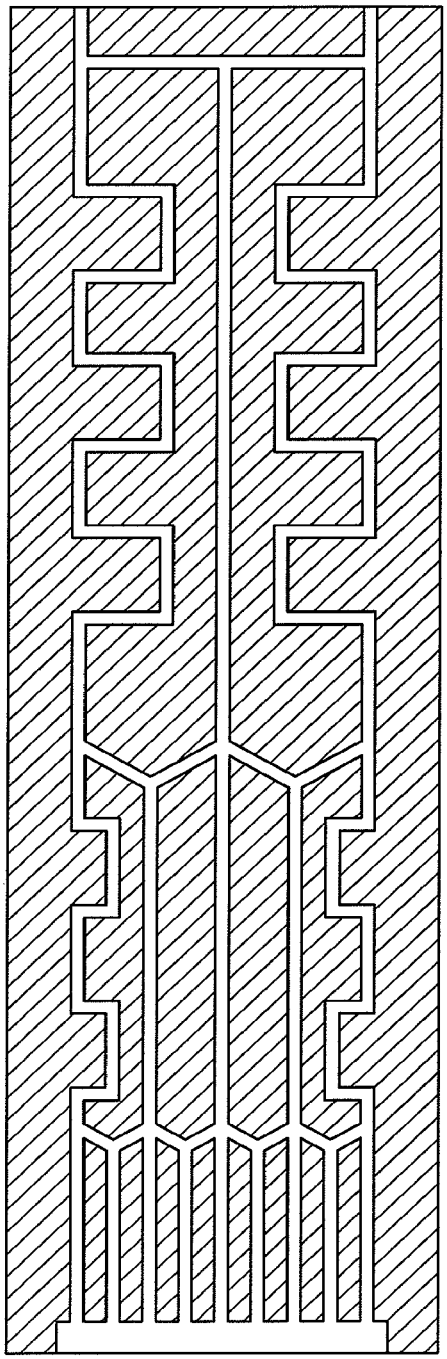
FIG. 8(*a*)-(*b*) illustrate images of fluid manipulation regions, FIG. 8(*a*) illustrating an embodiment where N=3 and FIG. 8(*b*) illustrating an embodiment where N=4.
Figure 8B:
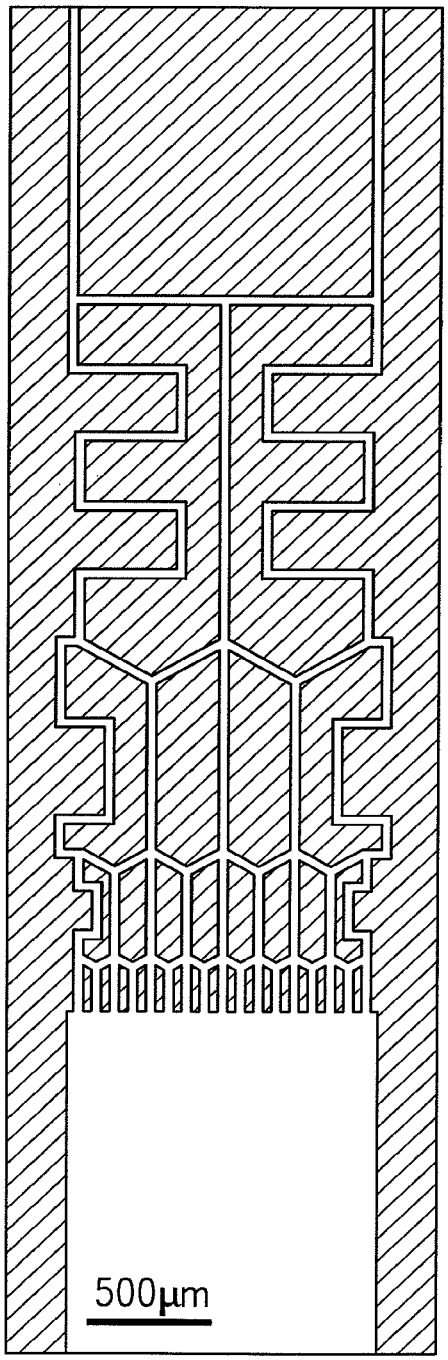
Figure 13:
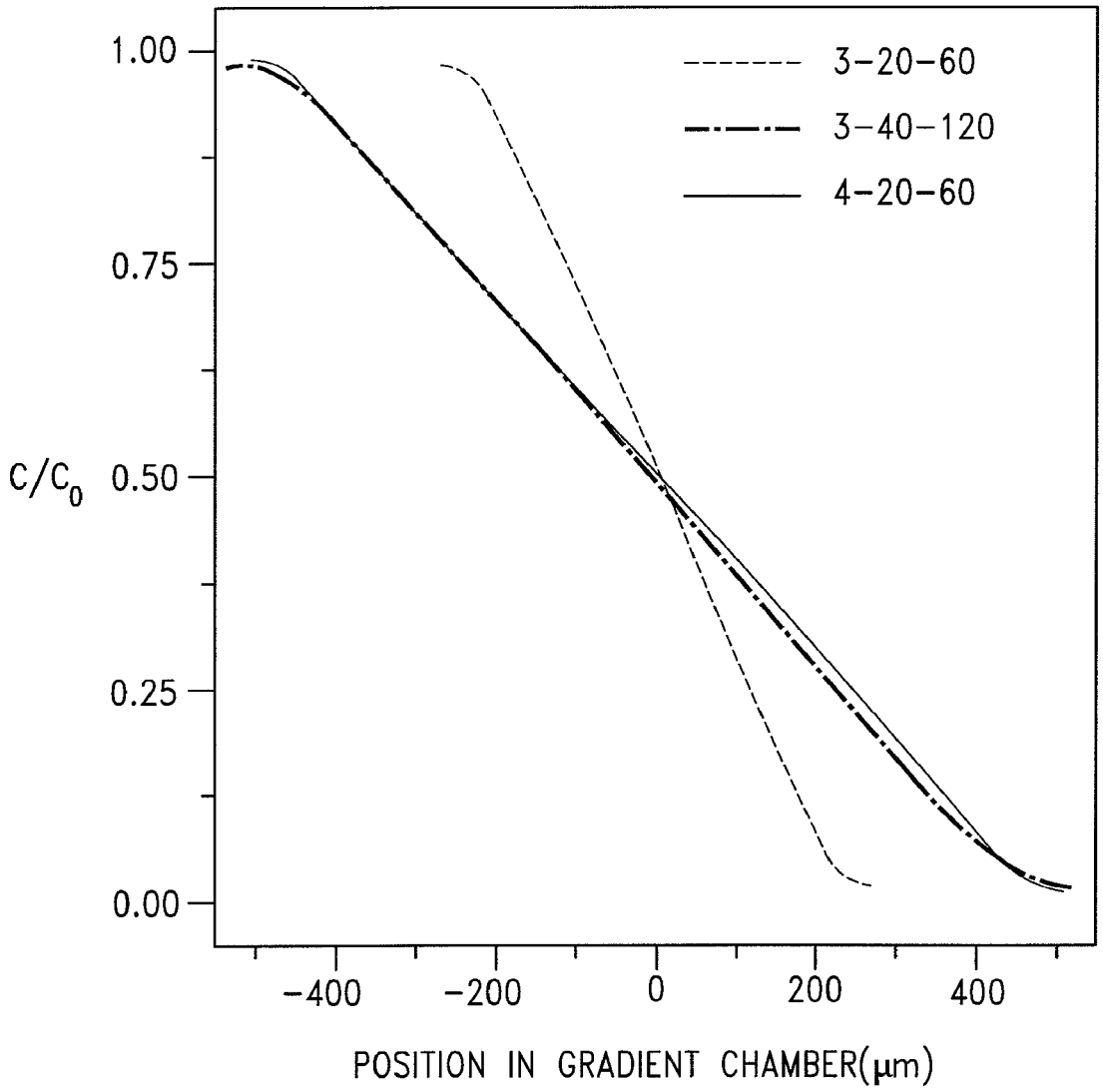
FIG. 13 illustrates graphs of gradient profiles for devices constructed according to the disclosure.

In order to evaluate the effects of the number of dilution-forming levels and of the channel spacing, we compared gradients formed using devices 3-20-60, 3-40-120, and 4-20-60. FIGS. 8(*a*)-(*b*) illustrate the fluid manipulation regions for devices 3-40-120 and 4-20-60, respectively, at the same magnification. The exterior channels and level lengths differ due to the need to balance flows and maintain sufficient in-channel diffusion. FIG. 13 illustrates gradients for concentration 1 at 100% and concentration 2 at 0% for l=100 μm for devices 3-20-60 and 4-20-60 and 1=400 μm for device 3-40-120. The extra level in device 4-20-60 produces 6.25% concentration steps rather than 12.5% steps for the other devices, yielding a larger linear region, covering 94% of the width of the gradient chamber compared to 88% for the other devices. However, FIG. 13 also illustrates that the additional level did not substantially improve the linearity of the gradient, for which the average difference between the experimental and theoretical gradient profiles was <1%. Similarly, the increase in channel spacing from 60 to 120 μm between devices 3-20-60 and 3-40-120 produced linear gradients, although the gradient took four times longer to reach linearity due to the increase in channel spacing. To quantify the difference between the theoretical and experimental profiles, we subtracted the theoretical gradient profiles from the experimental gradient profiles and calculated the standard deviation between the two.

Figure 14A:
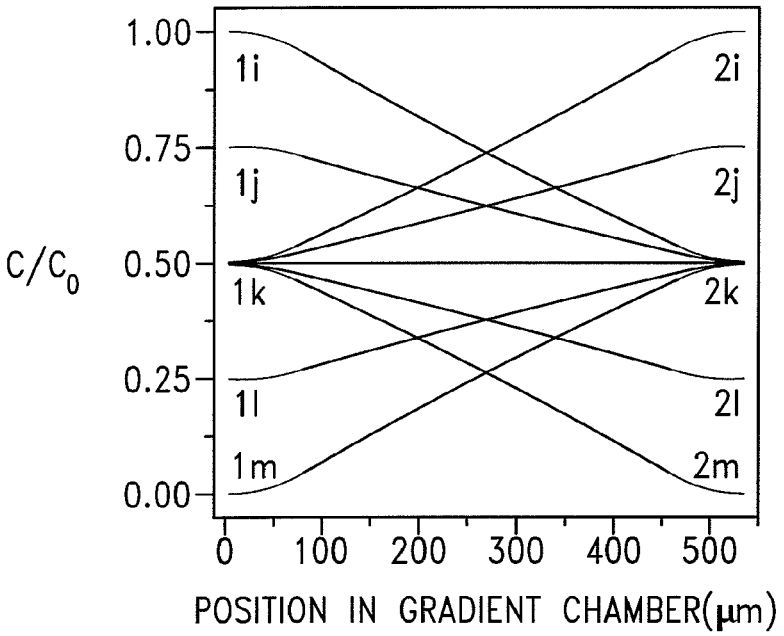
FIGS. 14 (*a*)-(*b*) illustrates a graph of gradient profiles across the gradient chamber for a device constructed according to the disclosure with pressure-driven flow, FIG. 14(*a*), and electrokinetic flow, FIG. 14(*b*)
Figure 14B:
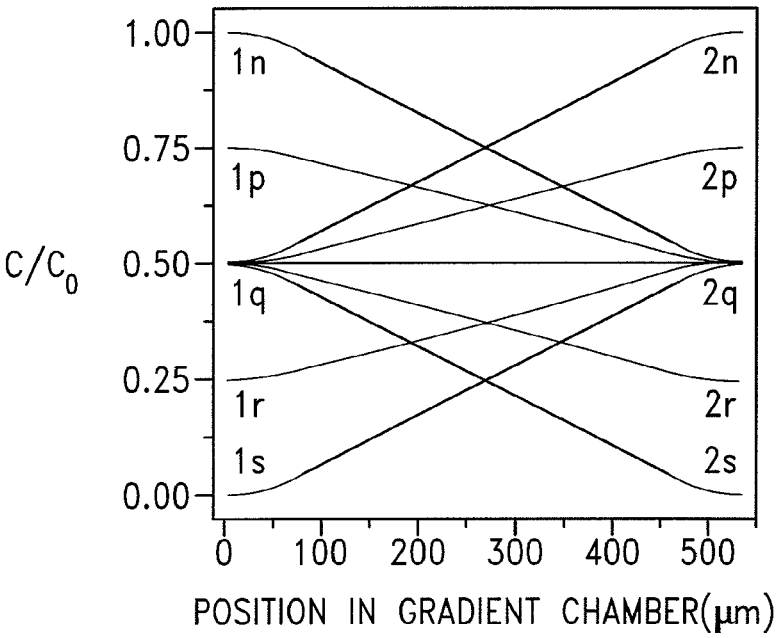

The relative standard deviations between the experimental and theoretical gradients were 0.8, 0.9, and 0.4% for devices 3-20-60, 3-40-120, and 4-20-60, respectively, meeting our criterion for a linear gradient, i.e., <1% difference between the theoretical and experimental gradient profiles. FIGS. 7, 11, 12, and 13 illustrate gradients generated with pressure driven flow. To compare gradients produced with pressure driven (FIG. 14(*a*)) and electrokinetic (FIG. 14(*b*)) flows, we set concentration 2 to 50% and varied concentration 1 from 100% to 0% in 25% increments (FIG. 14(*a*) profiles 1*i*-1*m*, respectively, for pressure-driven flow and FIG. 14(*b*) profiles 1*n*-1*s*, respectively, for electrokinetic flow) and exchanged concentrations 1 and 2 for FIG. 14(*a*) profiles 2*i*-2*m*, respectively, for pressure-driven flow and FIG. 14(*b*) profiles 2*n*-2*s*, respectively, for electrokinetic flow). Subtracting the pressure-driven gradient profiles from the electrokinetic gradient profiles and calculating the standard deviation between the two data sets yields a relative standard deviation between gradients formed with pressure-driven and electrokinetic flows of 0.9%, demonstrating that the gradients generated were very similar.

Example 2

Complex Gradient Formation

The rules described above with respect to creating linear gradient designs apply equally to creating gradient profiles with complex structures. In one example of a complex gradient design, monotonically decreasing functions were utilized, while maintaining the same overall design considerations as for the linear structure, namely a gradient chamber flow of 100 μm/s and 20 μm wide channels.

In the case of complex functions the concentration increment of the output channels of the dilution apparatus is not a constant, but a function dependent on the desired dilutions. In particular, for a nonlinear series of dilutions the ratio of the concentrations combining into a mixing tee is not identity anymore. Instead, this ratio of the combining concentrations is dictated by the two flows entering the mixing tee through the connector channels. It is known that the pressure or potential drop across any dilution forming level is constant. Therefore the pressure or potential drop along the connector channels of a merging junction must also be identical. Identical potential drop but different flows will result into an asymmetric (left vs. right) merging junction (FIG. 3(*b*)).

In a particular example, an exponential series of dilutions is implemented in a compact microfluidic structure such as a 3-20-60 device (corresponding to the number of channels, channel width and channel spacing, as explained above). It is worth mentioning that exponential type fluid dilutions (as well as logarithmic or hyperbolic) are harder to design because exponential functions do not go to zero like regular polynomial function, but instead extend asymptotically to zero. The asymptotical extents of a non-linear function cannot be reproduced by any finite design. Therefore the present device design instead reproduces the shape of a portion of a certain exponential function in normalized coordinates extending from 1 to as close to 0 as possible. In a specific example, the particular exponential function is $f(x)=\exp(-5x)$.

Figure 9:
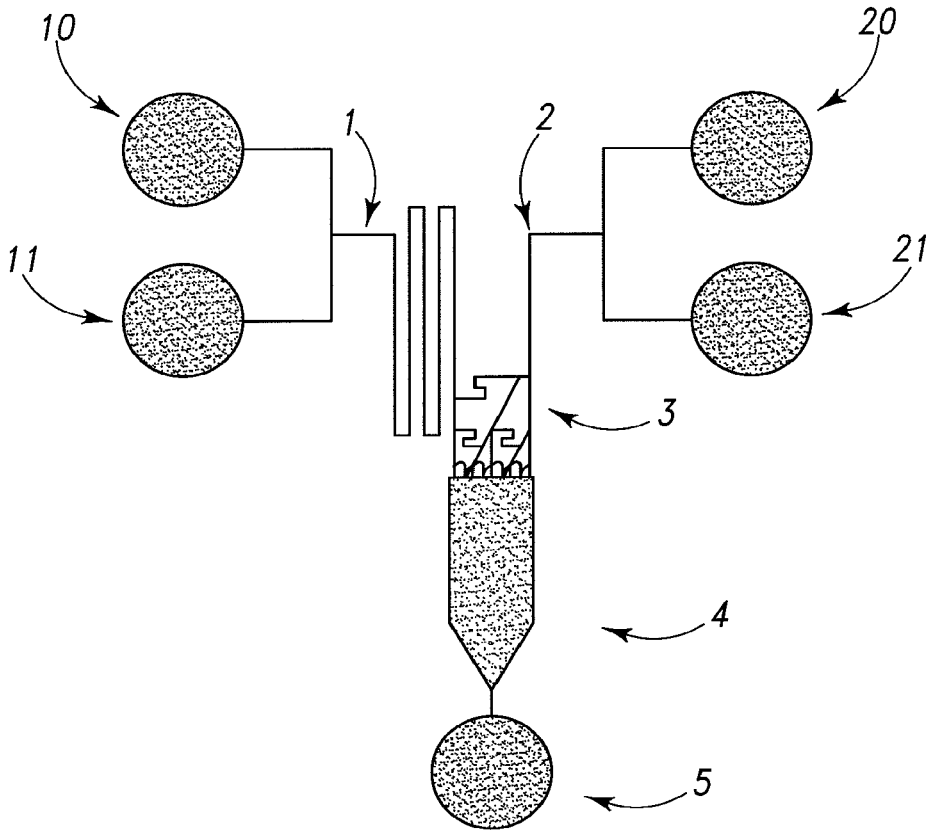
FIG. 9 illustrates a schematic of an embodiment having four inlet ports, a fluid manipulation region, a diffusion chamber and an outlet port.

A schematic of a 3-20-60 microfluidic device for generating controlled exponential chemical dilutions and corresponding gradients illustrating the inlet channels 1 and 2, fluid manipulating region 3, and gradient chamber 4 is presented in FIG. 9. The exponential fluid manipulating region for the 3-20-60 device is illustrated in greater detail in FIG. 10. The dilution forming region has three levels, L=1 to 3. The channels have uniform cross section, with lengths chosen to balance flow resistance. Similarly to FIGS. 12 and 13 for the linear dilution design, profiles with different "slopes" and/or offsets can be obtained for complex dilutions by changing the mixing ratios between inlet port 10 and inlet port 11 or between inlet port 20 and inlet port 21.

Example 3

Flow-Through Design

Figure 15:
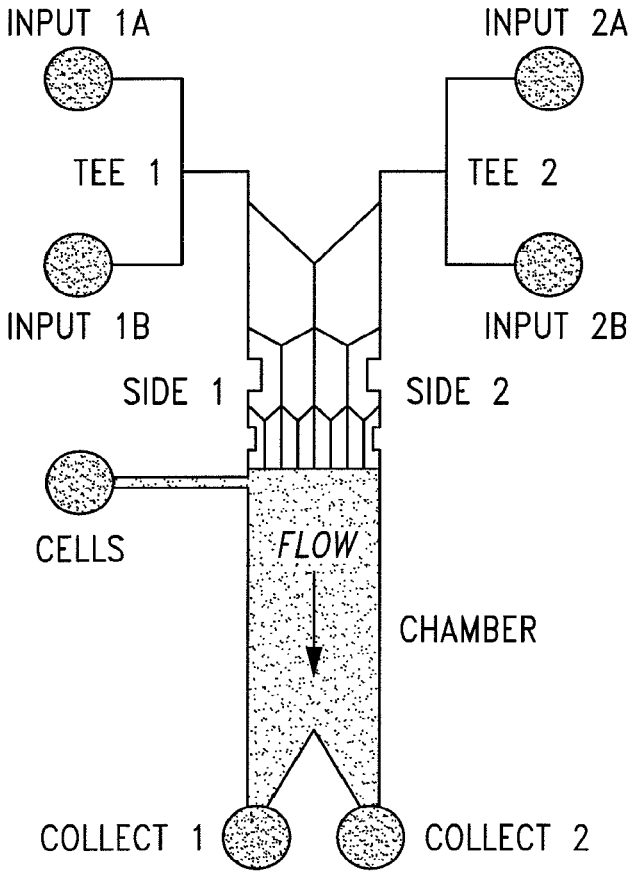
FIG. 15 illustrates a schematic of another embodiment constructed according to the disclosure.

The flow-through configuration of the of the apparatus illustrated in FIG. 15 helps to distinguish chemotaxis from a trapping process in which cells accumulate at a certain location as a result of reduced net velocity at that location. The ability to differentiate chemotaxis from trapping helps to determine whether cells, e.g., sperm, are attracted to the test substance or the swim velocity is reduced close to the test substance. In the latter case, the test substance may have had a negative influence on the cells, resulting in suppression of their movement. The flow-through configuration illustrated in FIG. 15 prevents trapping from occurring by maintaining a net flow of cells toward the waste reservoirs. The cells swim toward the test substance either in response to the gradient or randomly and are not permitted to accumulate in one location. Even in close proximity to the walls, reduced movement of cells due to zero flow at the test substance or buffer wall is not observed because the region of low flow is small (<5 μm) compared to the size of a sperm cell (~100 μm long). The flow-through configuration also permits samples responding or not responding to chemotaxis to be collected for further studies, e.g., fertilization.

Example 4

Additional Complex Gradients

Figure 16:
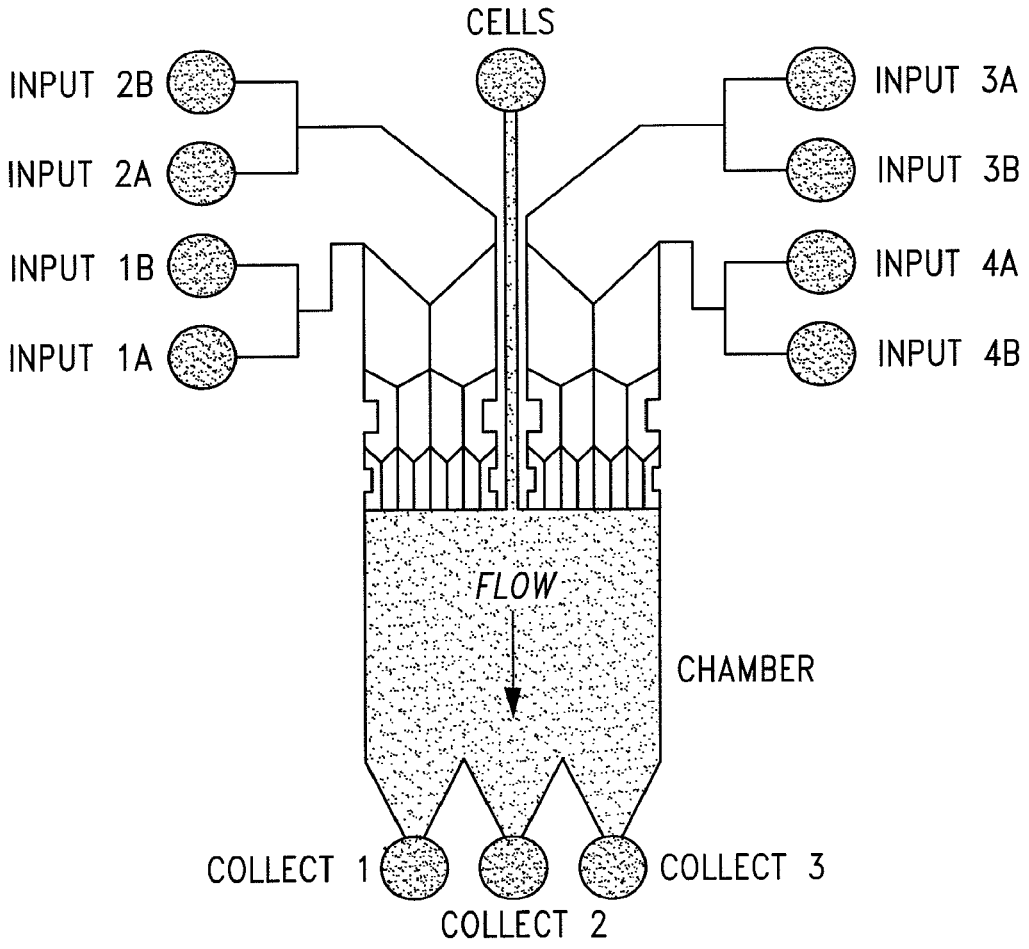
FIG. 16 illustrates a schematic of another embodiment constructed according to the disclosure.

Because the basic apparatus for forming the linear dilutions is compact and configured with fluid transport in a single direction, the apparatus can be repeated and positioned side by side or in arbitrary relative orientations or stacked in layers relative to the orientation of the apparatus to create more complex dilutions and corresponding gradients. FIG. 16 illustrates a microfluidic device with two dilutions forming apparatus. Such a structure can create dilutions and gradients with a variety of shapes including linear, V, Λ, and step functions. With such a structure, cells are introduced from the top center and are exposed to similar or dissimilar gradients from both sides. The chemicals used to form the gradients can be the same or different. In fact, such a device could be used to evaluate complementary or competing chemoattractants. Also, inputs 2 and 3 can be combined into a single input if the same chemical is going to be used.

Example 5

Spatial and Temporal Mobile Phase Gradients

Chemical gradients can be incorporated both spatially and temporally for liquid phase separations. Spatial gradients are advantageous because a variety of separation conditions can be screened quickly on a single sample, and higher separation performance can be obtained by applying the correct gradient in the appropriate second dimension channel. For example, when capillary electrophoresis is used for the first dimension (1D) separation, uncharged components are separated from charged components along the first dimension channel in FIG. 17. Often, the charged components are hydrophilic and the uncharged components are hydrophobic, and when a chromatographic separation is performed in the second dimension (2D), these components would require different gradients to maximize the peak capacity. These different gradients are possible using a chemical gradient applied laterally across the second dimension channels.

Figure 17:
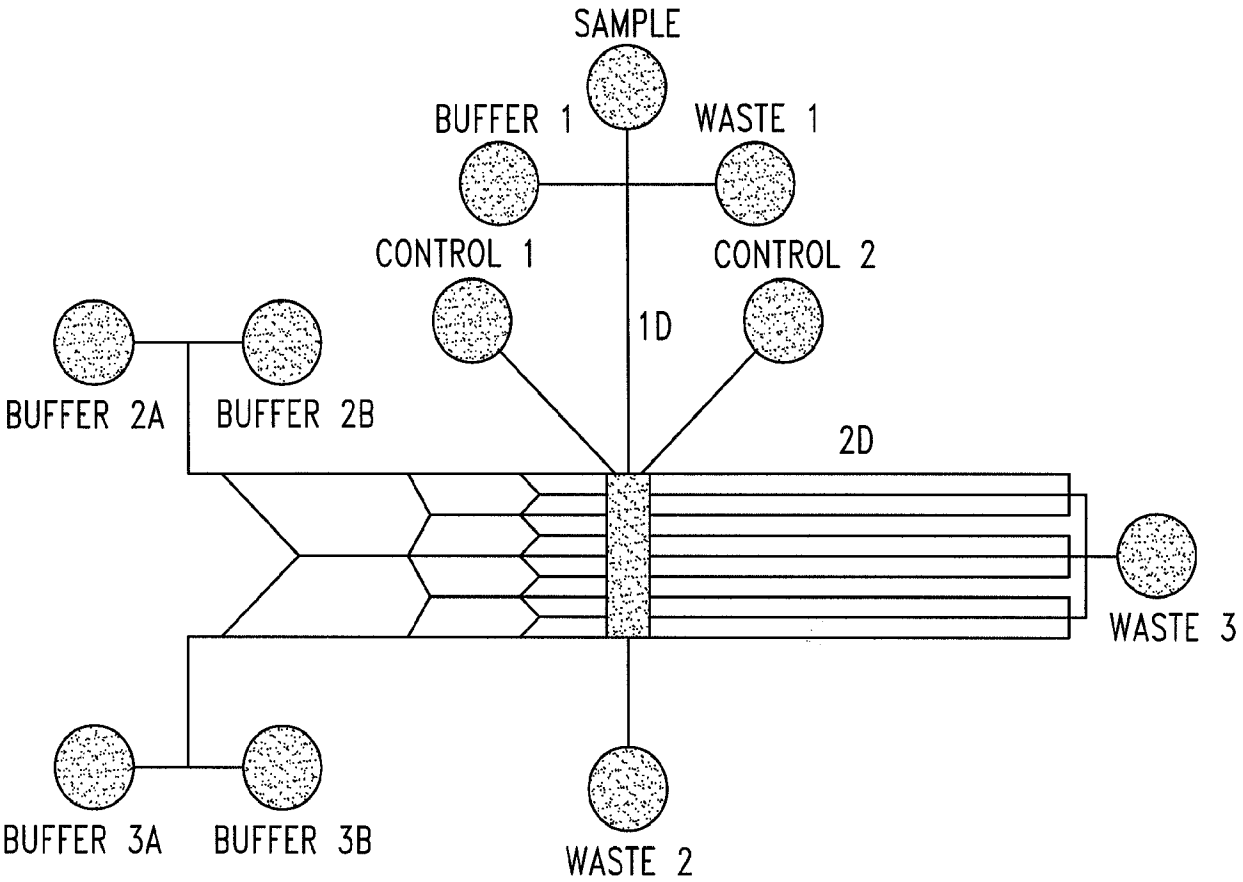
FIG. 17 illustrates a schematic of another embodiment constructed according to the disclosure.

FIG. 17 illustrates a schematic of a microfluidic device to generate spatial and temporal chemical gradients. This device combines the dilution forming region and a parallel channel design. In the schematic, the first dimension separation is conducted in the vertical channel. Once the first dimension separation is complete, the second dimension separation is conducted in the horizontal direction. Buffers 2 and 3 are mixed to generate a linear dilution series of the buffer components on the left hand side of the channel manifold. The number of channels entering the left side of the second dimension determines the number of discrete concentration levels. The number of output channels can be calculated as $2^N+1$ where N is the number of levels. A three level device is illustrated in FIG. 17. The starting and stopping points of the gradient and the slope of the gradient can be controlled by varying the relative contributions of two buffer streams. Having active control of the mixing of the a and b portions of each buffer enables a variety of chemical gradients to be evaluated. The flexibility in the design of the gradient permits the operator to tune the analysis to the sample.

While the disclosure is susceptible to various modifications and alternative forms, specific embodiments herein described in detail. It should be understood, however, that there is no intent to limit the disclosure to the particular forms described, but on the contrary, the intention is to cover all modifications, equivalents, and alternatives falling within the spirit and scope of the disclosure.

We claim:

1. A method of mixing fluids, comprising:

introducing a first fluid into a first inlet channel;

introducing a second fluid into a second inlet channel;

splitting the first fluid and the second fluid into two channels through a first bifurcated junction comprising the first channel and a second channel;

merging a first channel of the first fluid with a first channel of the second fluid, thereby forming a mixture of the first and second fluids;

splitting the first fluid, the second fluid and the mixture of the first fluid and second fluids into a plurality of additional channels through a plurality of bifurcated and trifurcated junctions;

merging the first fluid, the second fluid and mixtures thereof into a plurality of additional channels through a plurality of mixing junctions.

2. The method of claim 1 further comprising:

causing the first fluid, the second fluid, and mixtures thereof to flow into a gradient chamber.

3. The method of claim 2, further comprising:

causing the first fluid, the second fluid, and mixtures thereof to flow into a gradient chamber in a spatial order of decreasing concentration of the first fluid and increasing concentration of the second fluid.

4. The method of claim 3, further comprising:

causing the first fluid, the second fluid, and mixtures thereof to flow into a gradient chamber in a spatial order of substantially linearly decreasing concentration of the first fluid and increasing concentration of the second fluid.

5. The method of claim 3, further comprising:

causing the first fluid, the second fluid, and mixtures thereof to flow into a gradient chamber in a spatial order the decreasing concentration of the first fluid and increasing concentration of the second fluid can be expressed as a non-linear function that can be normalized from one to zero in a finite space.

6. A method for diluting a first fluid with a second fluid, comprising:

providing the first fluid to the first inlet and providing the second fluid to the second inlet of an apparatus comprising a microfluidic structure for manipulating fluids, the microfluidic structure comprising M inlet channels and a plurality of channels oriented among a plurality of bifurcated, trifurcated and merging junctions, wherein $M \geq 2$.

7. The method of 6, further comprising:

applying a force sufficient to cause the first fluid and the second fluid to flow through the apparatus and undergo successive dilutions.

8. The method of 1, further comprising:

applying a force sufficient to cause the first fluid and the second fluid to flow through the apparatus and undergo successive dilutions.

* * * * *